US005194048A

United States Patent [19]

Briggs

[11] Patent Number: 5,194,048

[45] Date of Patent: Mar. 16, 1993

[54] PARTICIPATORY WATER PLAY APPARATUS

[76] Inventor: Rick A. Briggs, P.O. Box 215, Oceanside, Oreg. 97134

[21] Appl. No.: 604,946

[22] Filed: Oct. 29, 1990

Related U.S. Application Data

[63] Continuation-in-part of Ser. No. 438,220, Nov. 20, 1989, Pat. No. D. 330,579.

[51] Int. Cl.[5] ..... A63G 21/00

[52] U.S. Cl. ..... 472/128; 482/35

[58] Field of Search ..... 472/117, 128; 482/35-37

[56] References Cited

U.S. PATENT DOCUMENTS 3,539,181 10/1970 Larsen .
4,057,244 11/1977 Gaspar .
4,573,679 3/1986 Janszen .
4,799,665 1/1989 Bracy .
4,805,898 2/1989 Jacober .

FOREIGN PATENT DOCUMENTS 1031693 6/1958 Fed. Rep. of Germany .

*Primary Examiner*—Richard E. Chilcot, Jr.
*Attorney, Agent, or Firm*—Marger, Johnson, McCollom & Stolowitz

[57] ABSTRACT

An endoskeletal or exoskeletal participatory water play structure comprised of play elements, water carrying conduits with attached water forming devices, associated valves, and issuing water effects, all of which define a three dimensional structure whereupon participants can manipulate valves to cause controllable changes in water effects that issue from the various water forming devices, and thus, alter the embodiment's overall appearance, sound and feel resulting in participant and observer recreational enjoyment.

21 Claims, 16 Drawing Sheets

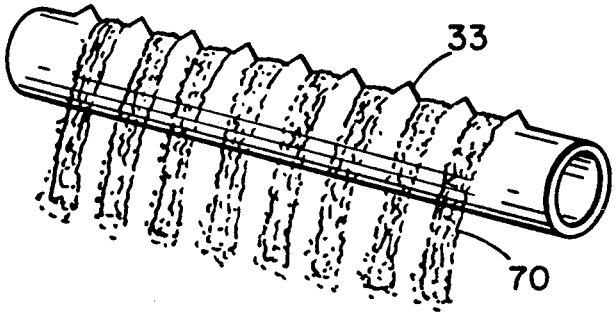
Fig. 6s
Fig. 6t
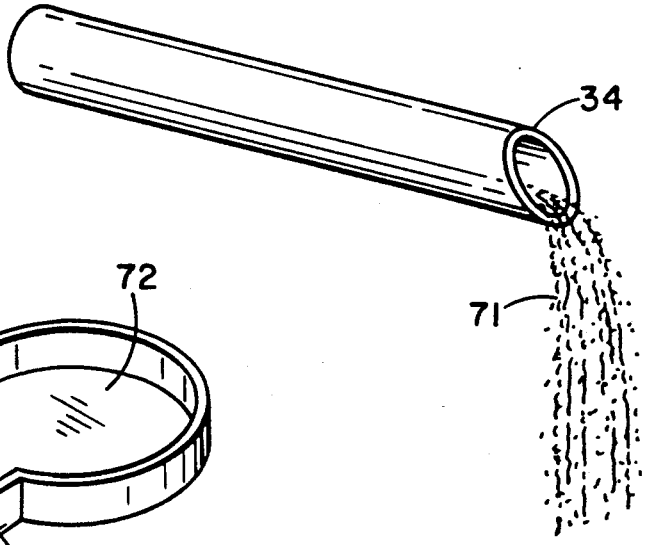
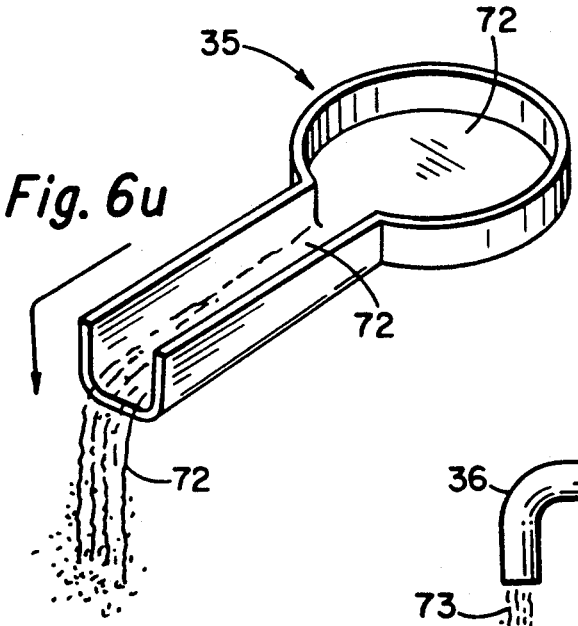
Fig. 6u
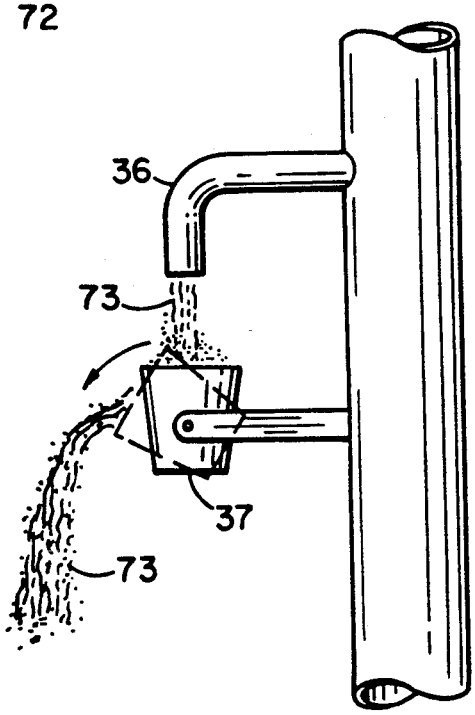
Fig. 6v 74
32
59
24
53
58
34
75
76
42c
40
43
42e
29
30
23
42f
57
42b
55
27
42i
56
33
51
54
42d
35
52
25
31
26
28
7
42h
42a
22
36
42g
37
44

PARTICIPATORY WATER PLAY APPARATUS

RELATED APPLICATIONS

This is a continuation-in-part of co-pending U.S. application Ser. No. 07/438,220 filed Nov. 29, 1989 for "Play Structure", now U.S. Pat. No. 330,579.

FIELD OF THE INVENTION

This invention relates in general to water amusement attractions, specifically a structure with a multiplicity of water forming devices, valves, play elements and water effects that in combination permit high capacity educationally interactive participatory water play that will physically change in appearance, sound and texture as it is played upon and around.

BACKGROUND OF THE INVENTION—DISCUSSION OF PRIOR ART

The 80's decade has witnessed phenomenal growth in the participatory family water recreation facility, i.e., the waterpark, and in water oriented ride attractions in the traditional themed amusement parks. The majority of attractions designed for these facilitates are targeted at the teen market. Children/parent water attractions are poorly lacking. The subject invention is aimed at satisfying this children/parent market segment for these larger scale commercial/public recreation facilities.

The amusement field is replete with inventions that utilize water as a passive play feature, however, none to date describe the participatory improvement contemplated by the subject invention, as an examination of some representative references will reveal.

Jacober et al., U.S. Pat. No. 4,805,898 issued Feb. 21, 1989 discloses a waterslide with a web-like flexible slide and buoyant landing pad that extends into a water-containing pool. The structure and operation of Jacober is limited to improvements to recreational waterslide systems and as such has no relevance to the present invention.

Bracy, U.S. Pat. No. 4,799,665 issued Jan. 24, 1989 discloses a collapsible sandbox and swimming pool playset which includes a swimming pool, sandbox, ladder, chin-up bar and slide. Bracy shares an attribute of the subject invention, i.e., componentization of play elements, however, the scope and scale of Bracy is far removed from the structure envisioned herein. Furthermore, the water feature of Bracy is limited to a small pool. No active participatory water effects or elements outside of the pool are described. Consequently, the structure and operation of Bracy has no relevance to the present invention.

Janszen, U.S. Pat. No. 4,573,679 issued Mar. 4, 1986 discloses a baseball batting device in which a tethered ball is rotated by water propulsion. The structure and operation of Janszen has no relevance to the present invention.

Gaspar, U.S. Pat. No. 3,539,181 issued Nov. 8, 1977 discloses a child's play seat with a plurality of water of sand amusement devices secured to a backboard attached to the play seat. The structure and operation of Gaspar has no relevance to the present invention.

Larsen, U.S. Pat. No. 3,539,181 issued Nov. 10, 1970 discloses an apparatus that takes the traditional backyard gym (swing) set and connects it to a garden hose with spray heads attached over each gym element. Larsen, although having some attributes of the subject invention is readily distinguished upon the following grounds:

(1) The structure of Larsen is limited to two dimensions and one direction of water motion, specifically a horizontal bar with attached downward directed spray heads. Conversely the structure of the subject invention, a multilevel water appliance, takes advantage of three dimensions with water effects occurring omnidirectionally. This three dimensional distinction functions to support participants at various elevations with multi-directional water effects at each elevation and also allows the creation of interior spaces, all of which were not contemplated by Larsen.

(2) The structure and function of Larsen's appliance is described and limited to a gym set with quasi-static spray attachments. The structure and function of the subject invention is described as a fully participatory hydro-dynamic water play structure, e.g., an interactive water play house, water play fire truck, or water play animal. A two dimensional aqua-gym is structurally distinct from the three dimensional interactive water playhouse, fire truck, animal or other physical structure as contemplated by the subject invention.

(3) The play elements for Larsen are limited to standard type gym elements, e.g. swing, seesaw, slide. The subject invention's play elements includes the water appliance superstructure itself, as well as a large variety of water and non-water play elements attached to and integrated with this superstructure, e.g., waterfall roof, fixed and rotating tunnels, tunnel slides, bridges, decks, crow's nests, water-cannons, geysers, water mirrors, bucket dumps, etc. Larsen type gym elements could be integrated, however, are not required.

(4) Larsen describes his water connection to his structure as "a garden hose connection." The standard garden hose connection (i.e., ½" to ⅝" diameter) is capable of spraying 15–20 gallons per minute. The subject inventions water connection is usually 4 to 6 inches in diameter and capable of issuing just under 500 to an average 2,000 gallons per minute with even greater flows dependent upon the size of the desired installation.

(5) Larsen described his water forming device as a "sprinkler or spray head" with one spray head per gym element. The subject invention's water forming devices includes: external and internal nipple nozzles; cone nozzles; water gun nozzles; geyser nozzles; platform nozzles; fog nozzles, water ball nozzles; laminar flow nozzles; water rake weirs; water curtain weirs; weirs with inclined surfaces; pipe-flows apertures; pool and runnel apertures; bucket apertures; as well as spray heads.

(6) Larsen describes the water effect that issues from his water forming device as a "fine . . . or course . . . spray". The subject invention's water effects include; waterfalls; jets; water dumps; laminar flows; water balls; geysers; bubbles; water curtains; pipe flows; mist; fog; as well as spray.

(7) Larsen attaches the control valve for each spray head to the horizontal bar under which the gym elements are suspended. In the traditional backyard gym (swing) set this horizontal bar is definitely not within reach of the intended children participants and is most often not within reach of an adult supervisor (owner) except by way of a ladder. Furthermore, Larsen does not teach that the valves of his structure are to be participant (children) control led, rather, he teaches that the participants only swing, play in, or run under the sprinkling water (Column 2, Lines 11 through 13). Larsen does teach that the owner of an existing gym can install hoses, connectors, spray heads, and valves to effect operation of the aqua gym (Column 2 Lines 14 through 16). And it is logical that the owner (adult) would presumably make a one-time adjustment to all valves and spray heads so as to permit the intended children participants to play thereunder. However, a clear distinction must be made between an owner who makes infrequent adjustments to a valve so as to invoke a preferred static water effect under which the participant plays (e.g., swings), and a participant who continually moves a valve to cause a change in water effect that is itself the purpose of intended water play. Larsen does not teach the later. Accordingly, Larsen omits a critical feature of the subject invention, i.e., the ability for the participant to intentionally change the form and volume of the water that he or she is playing with. The subject invention's entire structure and function is designed to enable participants to engage in water play by manipulating easily accessible valves which in turn change the form and volume of associated water effects. In that Larsen's valves are not within reach of the intended users, it is submitted that Larsen teaches away from participant control.

(8) Larsen does not address the issue of water run-off or recirculation. Unrestricted run-off can be damaging and wasteful. The subject invention contemplates use of a recirculation system to avoid damaging run-off and to promote water conservation.

Wolf, West Germany, Pat. No. 1,031,693, issued Jun. 1, 1958 discloses a polyhedron pipe frame structure with water supplied through the pipe frame to issue from a downward spraying nozzle located on an uppermost pipe and to issue from a multiplicity of holes drilled into the pipe frame. The water supply is turned on or off by a valve located at the base of the unit. The subject invention is readily distinguished from Wolf on the following grounds:

(1) Wolf does not address a critical feature of the subject invention, i.e., the ability of the intended user to operably control (through assorted valve means) the water that issues from the various water forming devices. Wolf employs a single on/off valve to serve the entire structure and such valve is not positioned or intended to be operated by the user as an element of participatory play. Furthermore, Wolf does not provide for independent control of a given water effect by an associated valve means. Wolf's structure is hydrodynamically static and remains unchanged during participant use. Conversely, the subject invention uniquely integrates the structure and function of numerous controllable valves with associated flow forming devices to produce a cornucopia of water effects all of which may be operably controlled by the user. By way of example, in the subject invention, pushing a lever causes a geyser to grow 6 feet in height; or hitting a button causes a ball of water to arch through the air; pulling a rope causes a spigot to spout or a bucket to dump its load of water; and turning a wheel causes a waterfall to splash over a participant located on an upper platform. Thus, in the subject invention physical interaction by the user creates a "live" hydrodynamically non-static structure that physically changes in appearance, sound, and texture each time it is used. In that Wolf's structure is hydrodynamically static and unchanged during use, Wolf teaches away from participant interactive control and structural metamorphose as taught by the subject invention.

(2) Wolf limits his water forming devices to one nozzle and two types of apertures. The nozzle is a standard downward directed shower nozzle. The apertures includes a series of holes drilled into the pipe frame and a plug with smaller holes drilled therein and reinserted into the pipe frame. The subject invention significantly expands the quality and quantity of water effects originating from the pipe structure, e.g., water falls; jets; water dumps; laminar flows; water balls; geysers; bubbles; water curtains; pipe flows; mist; fog; as well as spray from a shower or drilled hole aperture.

(3) The water effect that issues from Wolf's flow forming devices is limited to a spray in the horizontal or downward direction. Conversely, the subject invention is not limited to horizontal or downward directed sprays of water, rather, water issues in all directions.

(4) Wolf does not contemplate play elements incorporated within his pipe structure. The subject invention's play elements include the water appliance structure itself, as well as all of the elements within the attached to the structure, e.g., waterfall roof, fixed and rotating tunnels, tunnel slides, bridges, decks, water-cannons, geyser pulleys, water mirrors, crows nest, etc.

(5) Wolf does not address the issue of water run-off or recirculation. Unrestricted run-off can be damaging and wasteful. The subject invention contemplates use of a recirculation system to avoid damaging run-off and to promote water conservation.

BRIEF DESCRIPTION OF THE PRESENT INVENTION

To better understand the objects and advantages of the invention as described herein, a list of special terms as used herein are defined:

(1) Endoskeletal (or Endoskeleton) water play structure; refers to that class of water play structures wherein those elements which provide the primary structural support for the structure also carry the water to the various water effects utilized on the structure, e.g., a pipe frame.

(2) Exoskeletal (or Exoskeleton) water play structure; refers to that class of water play structures wherein the materials that provide the primary structural support to the structure do not carry water to the various water effects, rather, water is carried by an non structural conduit, e.g., flexible hose.

(3) Recirculating drain; includes drain systems associated with filters, pool skimmers, pool gutters, overflows, surge tanks, aeration, sanitation, cooling and any other similar water collection and redistribution system.

The primary objective of the present invention is to create a three dimensional endoskeletal or exoskeletal structure that in and of itself is play element, houses a multiplicity of other water and non-water play elements, allows for omni-directional orientation of water effects, and creates a myriad of changeable classes of water effects. The advantages of such an attraction are numerous. Large scale high capacity participatory water play for amusement facilities and public parks is made possible by the subject invention. The multi-level assembly of platforms, conduits, grates, bridges, tunnels, walls, pools, wheels, props, and controls for various water effects invite participants (wet or dry) to play and observers to enjoy hours of fun and fancy.

An equally important objective of the present invention is its interactive physical and participatory nature. Standard play equipment, as witnessed by the prior art, is hydrodynamically static and remains unchanged time after time. A significant advantage of the subject invention is its operational ability to allow changes to water effects by the simple physical acts of pushing a lever, pulling a rope, hitting a button or turning a valve. Such physical acts create an infinite array of water effects that differ as a function of the participant's using it, yet controllable, each time it is used.

A third objective of the subject invention is education, i.e., learning through interactive participation. By operating the various valves and controlling the various water effects participants, especially young children, learn the cause and effect relationship between action (pulling a rope or turning a wheel) and reaction (getting doused with a gush of water or watching a geyser erupt). Interactive participation allows the participant to enhance their knowledge of water, its many shapes, forms, textures and consequences under various dynamic conditions.

A fourth objective of the subject invention is synergistic integration. The method and manner in which components are arranged in the play environment significantly affects the educative process and amount of enjoyment that participants receive. Too often a play space will consist of isolated activities separated by an empty space which only functions to keep participants alone and apart. The subject invention is designed to coordinate all play elements, valves, and water forming devices into one integrated unit such that synergistic interplay results in a whole that is more exciting, creative and fun than the sum of its parts.

A fifth objective of the present invention is the componentization of structural additions, water play elements and the water effects so that each component can be isolated by cost to allow for maximum purchaser budget flexibility and permits subsequent additions over a period of years.

A sixth objective of the present invention is the use of a drain and water re-circulation system to avoid damaging run-off and to promote water conservation.

Other objectives and goals will be apparent from the following description taken in conjunction with the drawings included herewith.

BRIEF DESCRIPTION OF THE DRAWINGS

FIG. 6*s* pictures rake water fall weir forming a rake water fall.

FIG. 6*t* pictures open pipe aperture forming a non-pressurized gravity pour water effect.

FIG. 6*u* illustrates a pool and runnel aperture making a pond/stream/fall combo water effect.

FIG. 6*v* illustrates a bucket aperture making a bucket dump water effect.

Figure 1:
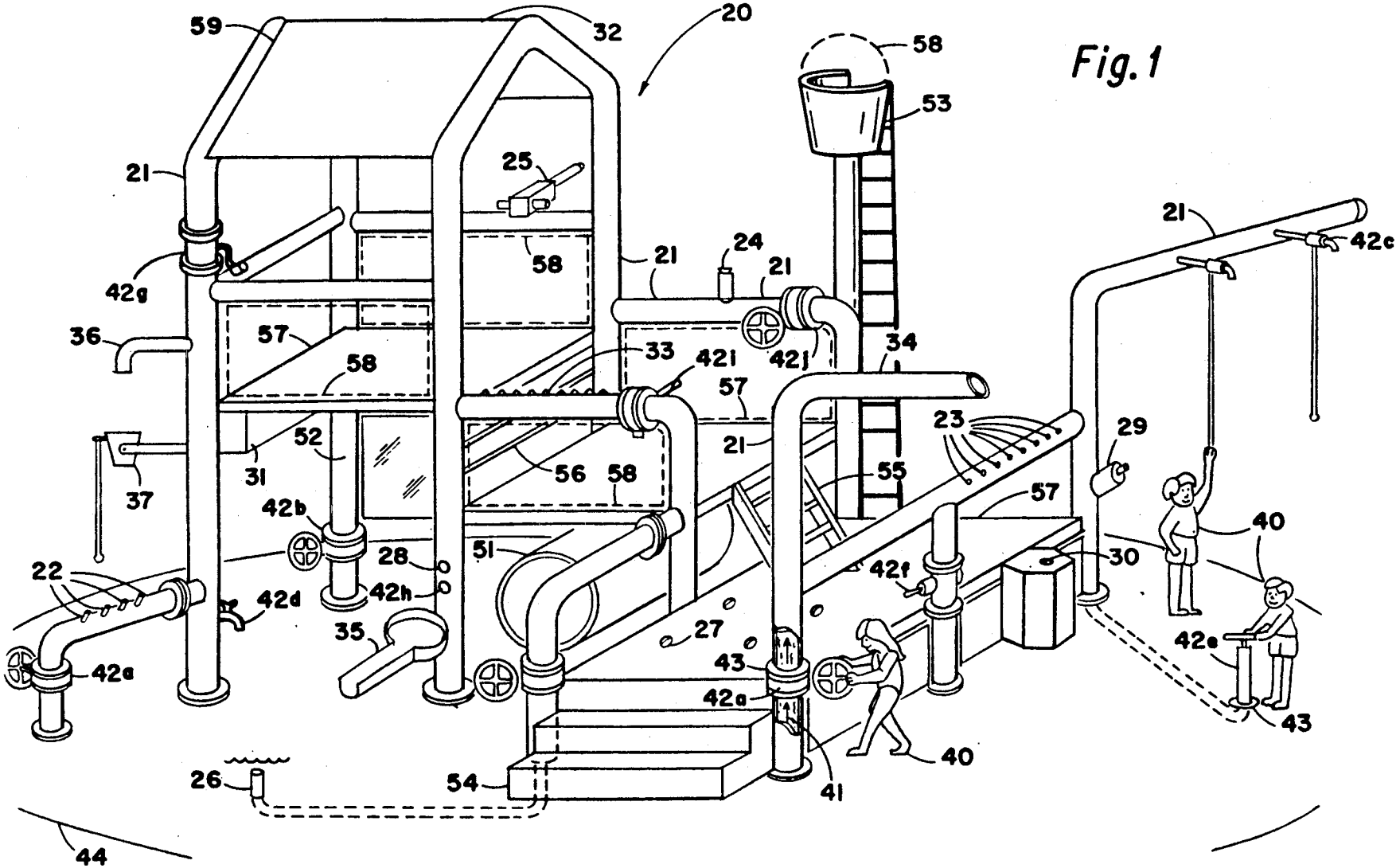
FIG. 1 depicts a generalized view of an endoskeletal "playhouse" participatory water play structure.

The subject invention is comprised of several embodiments that can stand alone or be combined to function for the recreational purposes as described herein.

DETAILED DESCRIPTION OF THE ENDOSKELETAL PARTICIPATORY WATER PLAY STRUCTURE

Turning to FIG. I there is illustrated a perspective view of an embodiment of the subject invention known as an endoskeletal participatory water play structure 20. Endoskeletal participatory water play structure 20 is comprised of a hollow conduit multi-elevational polyhedral endoskeleton 21 with connected water forming devices e.g., nozzles, weirs and apertures further described as follows: an external nipple nozzles (s) 22; an internal nipple nozzle(s) 23; a cone nozzle 24; a water gun nozzle 25; a geyser nozzle 26; a platform nozzle 27; a fog nozzle 28; a laminar flow nozzle 29; a jumping water ball nozzle 30; a curtain water fall weir 31; a wear with inclined surface 32; a rake water fall weir 33; an open pipe aperture 34; a pool and runnel aperture 35; a bucket aperture 36; and a hinged bucket 37. Water forming devices (22, 23, 24, 25, 26, 27, 28, 29, 30, 31, 32, 33, 34, 35, 36, 37) may be joined to endoskeleton 21 by glue, weld, screw, threaded coupling or bolted flange (not shown).

To enable a participant(s) 40 to adjust the flow of water 41 to water forming devices (22, 23, 24, 25, 26, 27, 28, 29, 30, 31, 32, 33, 34, 35, 36, 37), a separate control valve 42 is connected to endoskeleton 21 at a point prior in the line of flow by way of bolted flange 43, or glue, weld, screw, or threaded coupling (not shown). Different types of control valves 42 are employed so as to require different types of participant 40 interaction. By way of example, control valves 42 include; wheel controlled butterfly valves 42*a;* lever controlled butterfly valves 42*b;* counter-weight valves 42*c;* standard gate valves 42*d;* below water (or grade) gate valves 42*e;* flush valves 42*f;* hydraulic flush valves 42*g;* solenoid valves 42*h;* lever controlled ball valves 42*i;* wheel controlled ball valves 42*j.*

The degree of valve control can range from between full water on to full water off and any desired intermediate position (akin to a rheostat), or limited to a simple water on/off (akin to a switch).

Non-water effect play elements can also be attached to endoskeleton 21 to enhance participatory play. Examples of non-water effect play elements include a static/rotating tunnel 51; a mirror 52; and a crow's nest 53. Static/rotating tunnel 51 can also be utilized to connect to the varying elevations of endoskeleton 21 and permit participant 40 to slide to different levels of endoskeletal participatory water play structure 20. Static/rotating tunnel 51 and crow's nest 53, can be fabricated from metal, PVC, fiberglass, plastic, or other suitable material. Mirror 52 is fabricated of reflective metal or reflective plastic.

To facilitate participant 40 movement, a stair 54, a ladder 55, and a set of bars 56 connects different elevations of endoskeleton 21. A floor platform 57 provides an elevated play area. Stair 54, ladder 55, bar 56 and floor platform 57 are attached to endoskeleton 21 by either welds or clamps (not shown). To assist in defining spatial boundaries throughout endoskeleton 21, an enclosure panel 58 is attached by glue, welds or clamps (not shown). Enclosure panels 58 also serve to insure participant safety in the upper elevations of endoskeleton 21, as well as preventing unwanted participant entrapment. Roof panels 59 are positioned upon the uppermost levels of endoskeleton 21 and can serve as a shade device for participants 40. Stairs 54, ladders 55, bars 56, floor platforms 57, enclosure panels 58, and roof panels 59 are preferably made from metal, fiberglass wood, PVC, reinforced fabric or other structurally suitable material.

A pool 44 within which endoskeletal participatory water play structure 20 is located can range in depth from a zero depth drainage basin to approximately 1 meter. At a minimum the width of pool 44 need extend an amount sufficient to collect the majority of wind-blown overspray. The maximum size of pool 44 is only limited by practicality and budget. Filtration and water heating systems are to be incorporated per local building code. Endoskeleton 21 is made of rust resistant metal, fiberglass, polyvinylchloride (PVC), or other structurally and functionally suitable "conduit". As used herein, "conduit" includes by definition all manners or shapes of pipe, tubing, or other functionally shaped water carrying channel. All such conduit is hollow to allow passage of water 41, yet of sufficient strength to permit multiple participants 40 to safely climb within and upon its three dimensional frame. The size of conduit will range from a minimum of approximately 1 cm internal diameter to a maximum of approximately 40 cm internal diameter. Conduit can be formed into diverse shapes by bending and piecing together different length sections with glue or joints welds or by pressure clamps, screws, threaded couplings or flanges (not shown).

At a minimum, endoskeleton 21 defines a three dimensional space bounded by three or more interconnected conduits of sufficient size and separation to permit participants 40 to fit between and operate the connected water forming devices (22, 23, 24, 25, 26, 27, 28, 29, 30, 31, 32, 33, 34, 35, 36, 37), associated valves 42 (*a, b, c, d, e, f, g, h, i, j*) and incorporated play elements (50, 51, 52, 53). At a maximum the size of endoskeleton 21 and the various valves, water forming devices and play elements are limited only by functionality, budget and site constraint.

Figure 2:
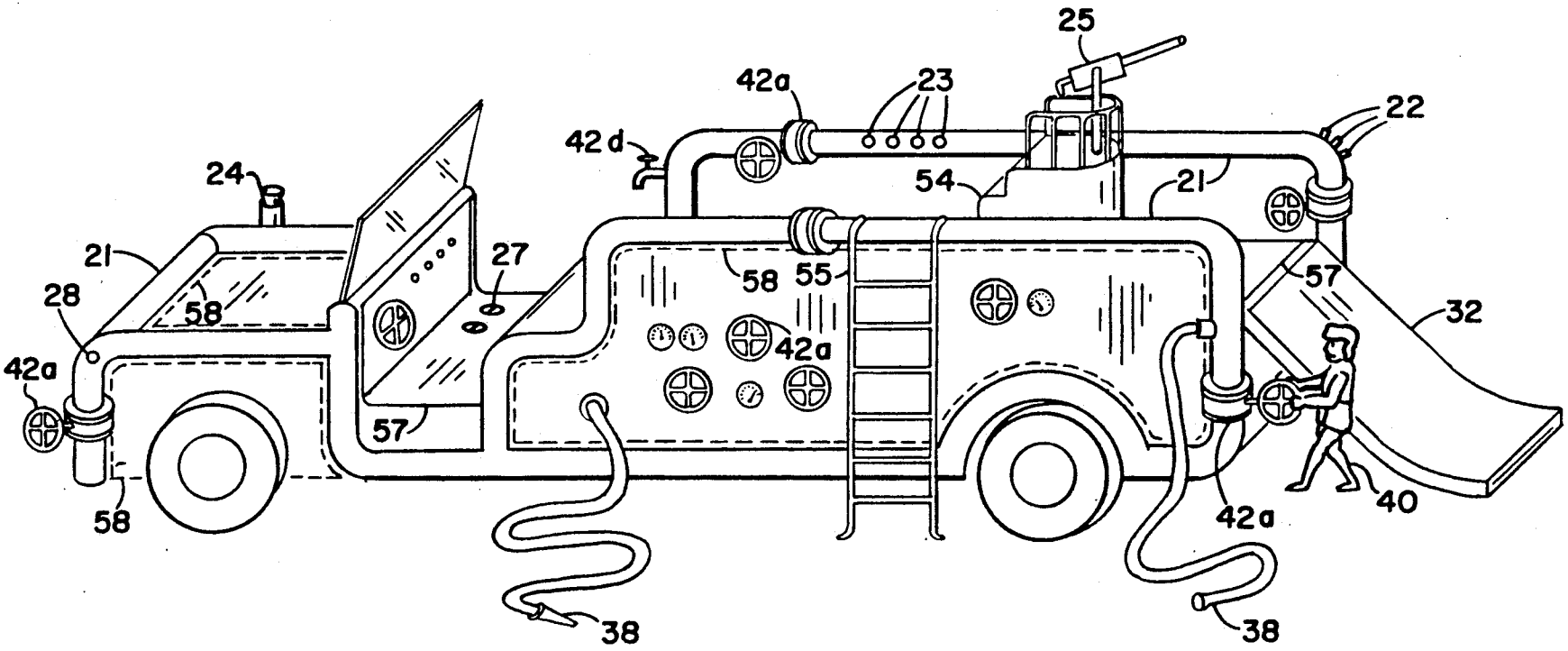
FIG. 2 depicts a generalized view of an endoskeletal "five truck" participatory water play structure.

Additionally, the shape of endoskeleton 21 is easily conformed into recognizable vehicular or animal like structures. FIG. 2 depicts endoskeleton 21 in the shape of a participatory water play "fire-truck", with water forming devices, e.g., a external nipple nozzle(s) 22; internal nipple nozzle(s) 23; cone nozzle 24; water gun nozzle 25; platform nozzle 27; fog nozzle 28; weir with inclined surface 32; flexible hose nozzle(s) 38; and with valves 42, e.g., wheel controlled butterfly valve 42*a* and gate valve 42*d.* Ladder 55 and floor 57 assist participant 40 in movement and support. Enclosure panels 56 assists in defining the three dimensional surface shape of "fire truck" endoskeleton 21.

Figure 3:
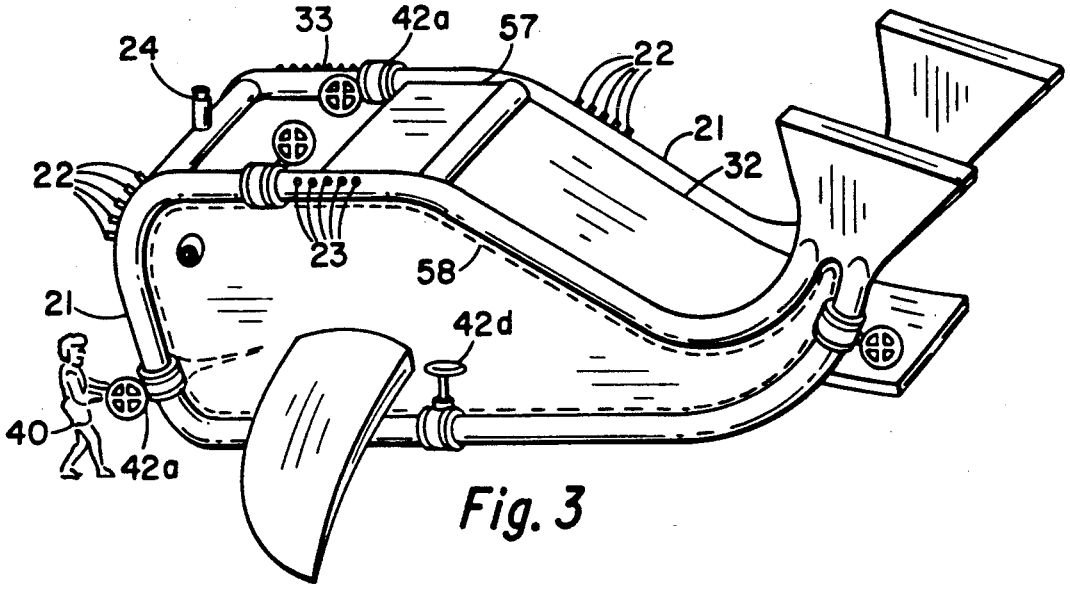
FIG. 3 depicts a generalized view of an endoskeletal "whale" participatory water play structure.

FIG. 3 depicts endoskeleton 21 in the shape of a participatory water play "whale", with water forming devices, e.g., external nipple nozzle(s) 22; internal nipple nozzle(s) 23; cone nozzle 24; weir with inclined surface 32; rake waterfall weir 33; and with valves 42, e.g., wheel controlled butterfly valve 42*a* and gate valve 42*d.* Ladder 55 (not shown) and floor 57 assist participant 40 in movement and support. Enclosure panels 58 assists in defining the three dimensional surface shape of "whale" endoskeleton 21.

Figure 4:
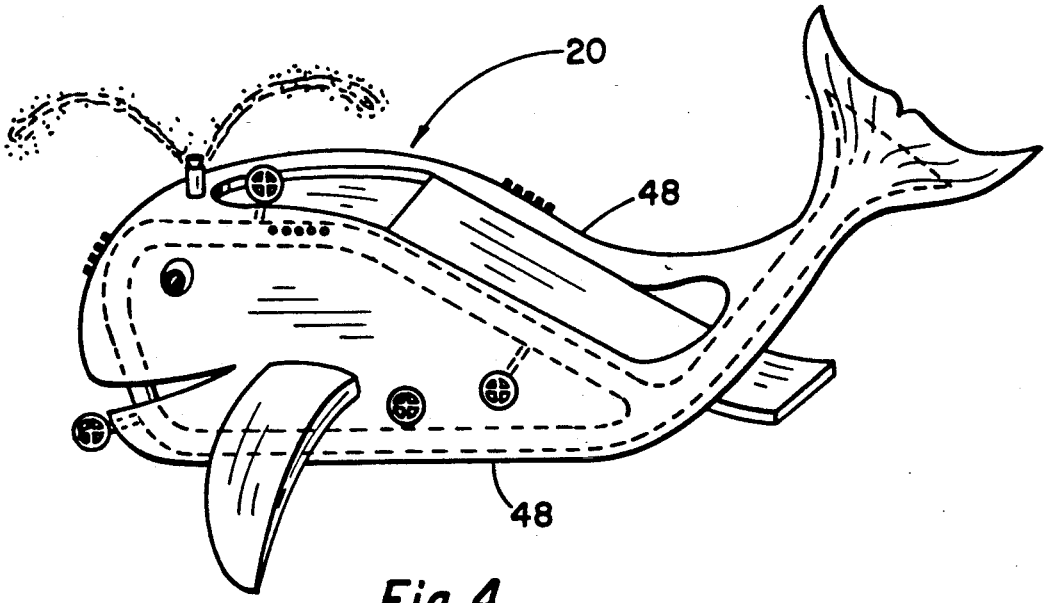
FIG. 4 depicts a generalized view of an endoskeletal "whale" participatory play structure with an exterior skin.

FIG. 4 illustrates the whale of FIG. 3 clad in a surfacing material 48. Surfacing material 48 can act as the exterior skin of endoskeletal participatory water play structure 20. This can be especially advantageous when a more "life-like" physical representation is desired. Surfacing material 48 can be fabricated from fiberglass, concrete, foam, gunite, wood, plastic, rubber, fabric or any other surface material that is suitable for participatory play.

Numerous other types, styles and shapes of participatory water play structures are available, by way of example and not limitation, such structures could include a fort, teepee or factory; vehicles could include a rocket ship, automobile, submarine, or fireboat; and animals could include a dinosaur, elephant or rhino.

Figure 5:
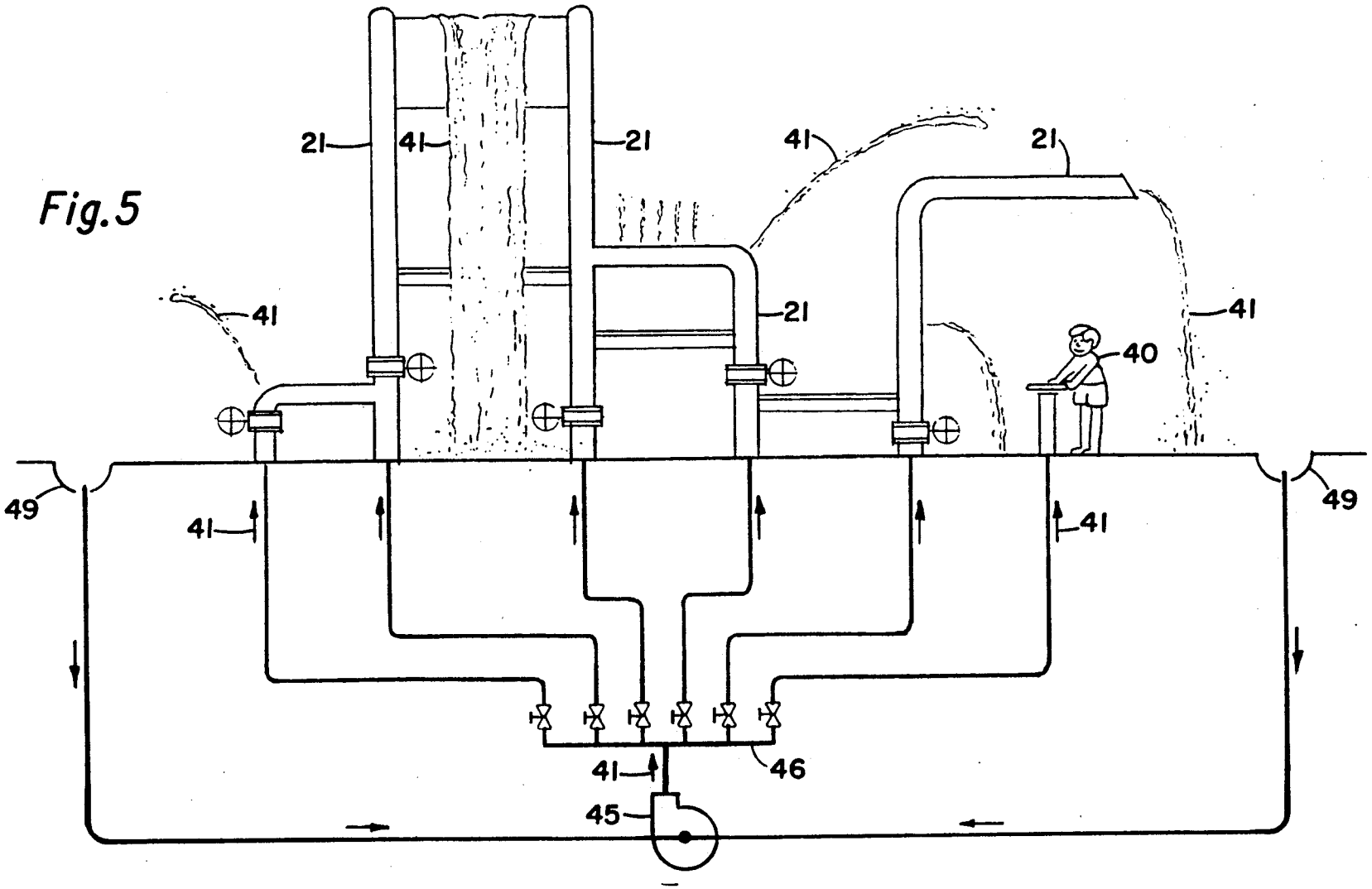
FIG. 5 is a schematic plumbing drawing for the endoskeletal plate structure.

Turning to FIG. 5 there is illustrated a schematic plumbing diagram which illustrates the flow of water 41 throughout the subject invention. A circulating pump 45 supplies water 41 to a master control valve manifold 46 which in turn provides for on/off and balanced water control to the regions of endoskeleton 21 as indicated. Master control valve manifold 46 is not intended for use by participants 40, rather, master control valve manifold 46 allows the operator of an embodiment of the subject invention to regulate safe and efficient water flow, or to terminate water service to all or specific regions of endoskeleton 21. A recirculating drain 49 enables water 41 to return to pump 45 for recirculation.

Figure 6A:
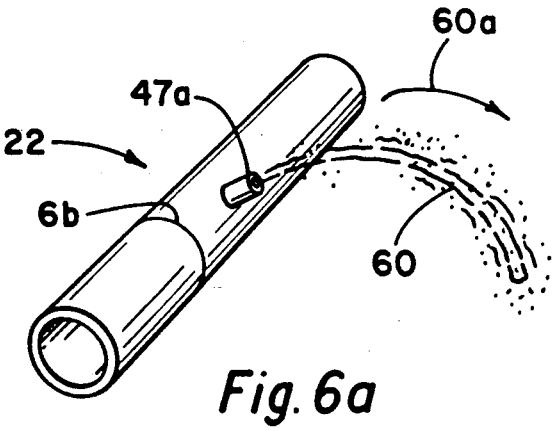
FIG. 6*a* shows a perspective view of an external nipple nozzle angled at 45 degrees from the horizontal to form an arch jet.
Figure 6B:
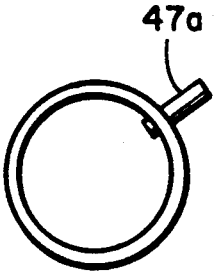
FIG. 6*b* is a cross-section of the external nipple nozzle of FIG. 6*a*.

FIG. 6*a* through FIG. 6*v* illustrate representative water forming devices and their associated kinetic water effects. Starting with FIG. 6*a* (perspective view) and FIG. 6*b* (cross-section of 6*a*) there is detailed external nipple nozzle 22 comprised of an external nipple 47*a* which perforates the endoskeleton and is secured by glue, thread or weld. Jet 60 water effect issues from external nipple nozzle 22.

Figure 6C:
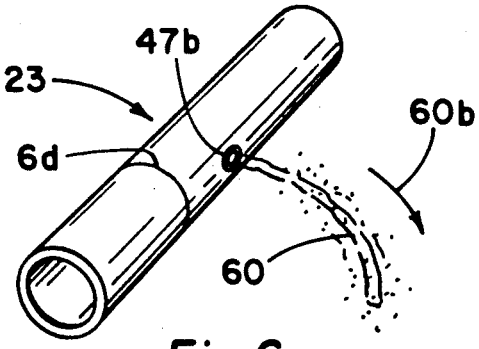
FIG. 6*c* shows a perspective view of an internal nipple nozzle aimed horizontally to form an angle jet.
Figure 6D:
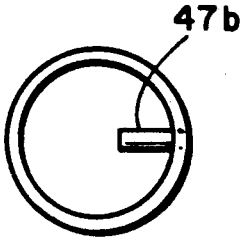
FIG. 6*d* is a cross-section of the internal nipple nozzle of FIG. 6*c*.

FIG. 6*c* (perspective view) and FIG. 6*d* (cross-section of 6*c*) details an internal nipple nozzle 23 which is similar to external nipple nozzle 22 except that internal nipple 47*b* is oriented inward and flush to the outside of the endoskeleton, with the outside surface made smooth so that external appearance is simply of a hole in the endoskeleton. Internal nipple nozzles 23 are used for purposes of safety, especially in the lower regions of endoskeletal participatory water play structure 20 where participants 40 could make contact with any external nipples. External nipple nozzle 22 and internal nipple nozzle 23 produce similar jet 60 water effects, with external nipple nozzle 22 producing jet 60 with a slightly smoother rod like surface.

Figure 6E:
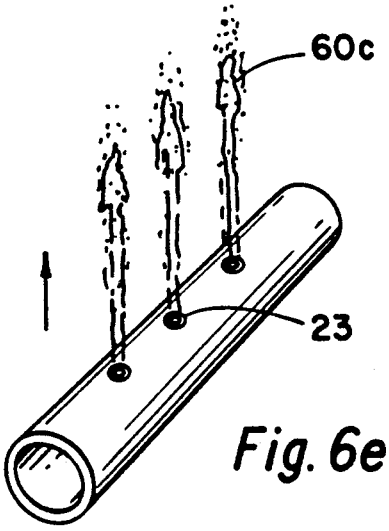
FIG. 6*e* illustrates a series of vertical jets produced when nipple nozzles are directed vertically.
Figure 6F:
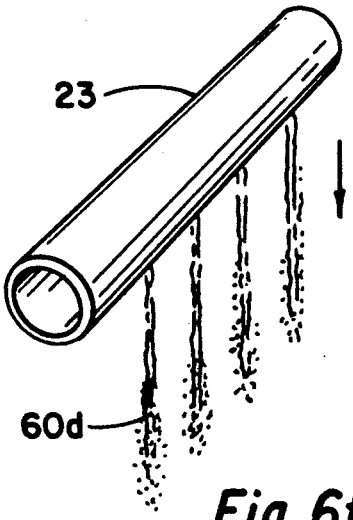
FIG. 6*f* illustrates a series of bar jets produced when nipple nozzles are directed downwardly.
Figure 6G:
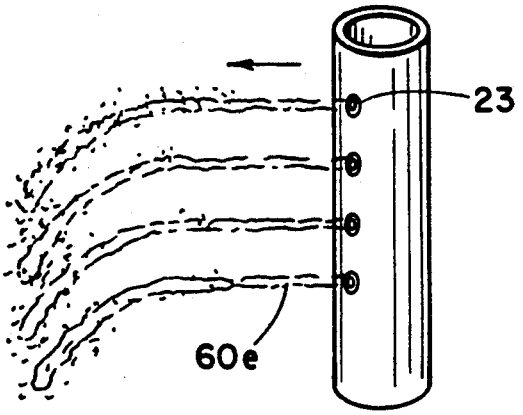
FIG. 6*g* depicts a series of horizontal jets created when nipple nozzles are oriented one-on-top-of-the-other along the vertical axis.
Figure 6H:
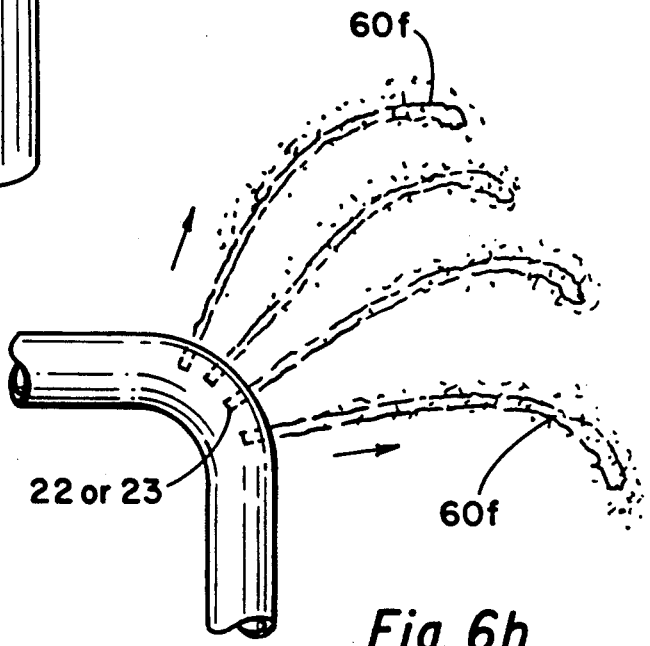
FIG. 6*h* depicts a series of peacock jets created when nipple nozzles are linearly oriented around a curve conduit.

The orientation of nipple nozzles 22 and 23 relative to the force of gravity produces identifiably different jet water effects. FIG. 6*a* illustrates an arch jet 60*a* formed when nipple nozzle 20 is directed at a 45 degree angle from the vertical. FIG. 6*c* illustrates an angle jet 60*b* formed when nipple nozzle 23 is directed at a 90 degree angle from the vertical. FIG. 6*e* shows a series of vertical jets 60*c* produced when nipple nozzles 23 are directed vertically. FIG. 6*f* shows a series of bar jets 60*d* produced when nipple nozzles are directed downwardly. FIG. 6*g* depicts a series of horizontal jets 60*e* created when nipple nozzles 23 are oriented one-on-top-of-the-other along the vertical axis. FIG. 6*h* depicts a series of peacock jets 60*f* created when nipple nozzles 23 are linearly oriented around a curve.

Figure 6I:
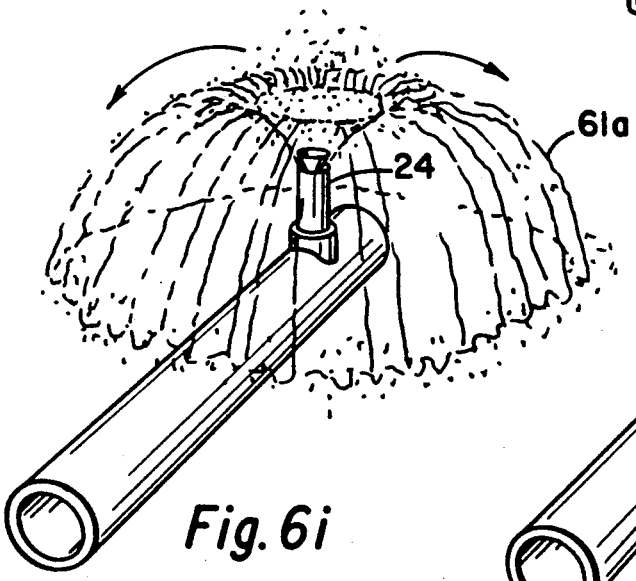
FIG. 6*i* shows a cone nozzle producing an umbrella spray.
Figure 6J:
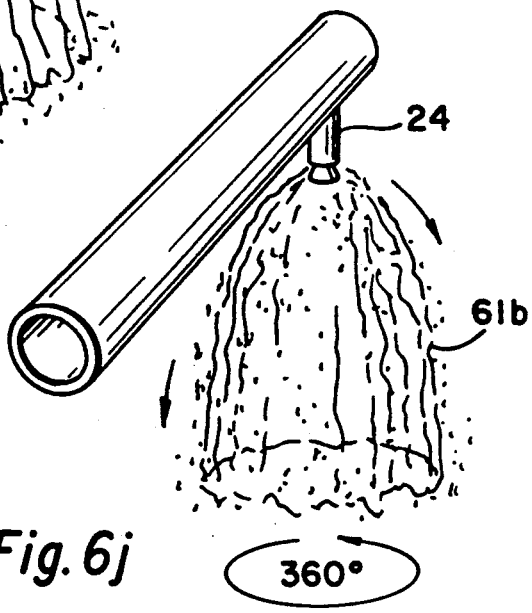
FIG. 6*j* shows a cone nozzle producing a cone spray.

FIG. 6*i* details cone nozzle 24. When oriented with cone nozzle 24 pointed predominantly vertically cone nozzle 24 produces an umbrella spray 61*a*. FIG. 6*j* shows cone nozzle 24 pointed in a predominantly downward direction and forming a cone spray 61*b*.

Figure 6K:
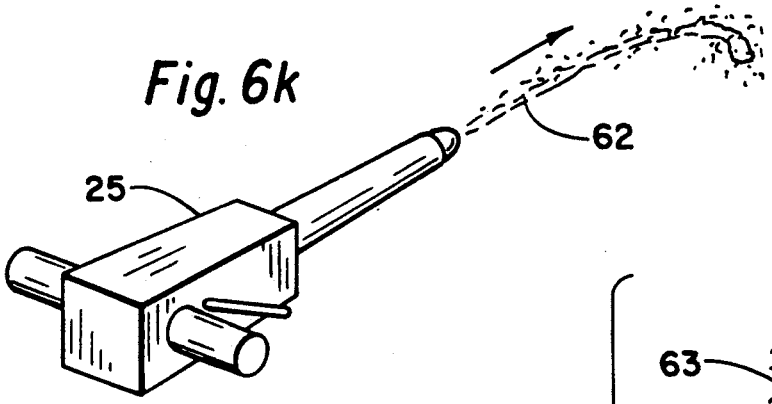
FIG. 6*k* illustrates a water gun forming a water gun jet.

FIG. 6*k* illustrates water gun nozzles 25 forming a water gun jet 62.

Figure 6L:
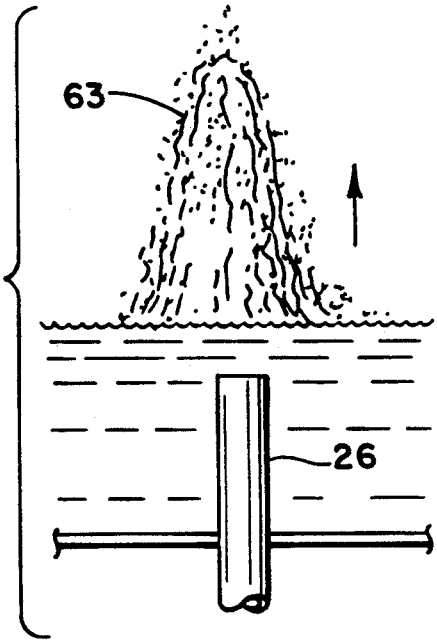
FIG. 6*l* illustrates geyser nozzle forming a geyser.

FIG. 6*l* illustrates geyser nozzle 26 forming a geyser 63. In order for geyser 63 to properly form, geyser nozzle 26 must be positioned under a few inches of water and oriented towards the vertical.

Figure 6M:
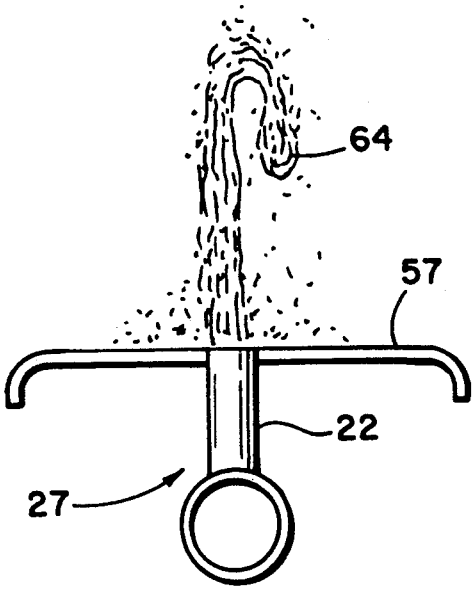
FIG. 6*m* depicts a platform nozzle forming a platform spout.

FIG. 6*m* shows platform nozzle 27 comprised of external nipple nozzle 22 vertically positioned with nozzle opening flush with an opening through floor platform 57. Platform nozzle 27 forms a platform spout 64 water effect.

Figure 6N:
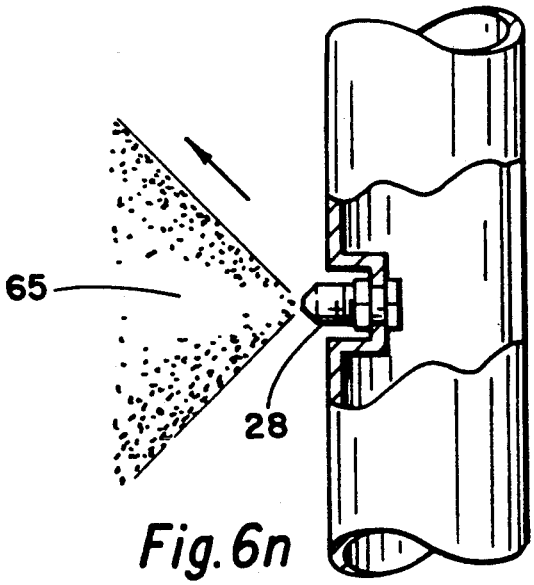
FIG. 6*n* depicts a fog nozzle issuing a fog water effect.

FIG. 6*n* shows fog nozzle 28 issuing a fog 65 water effect.

Figure 6O:
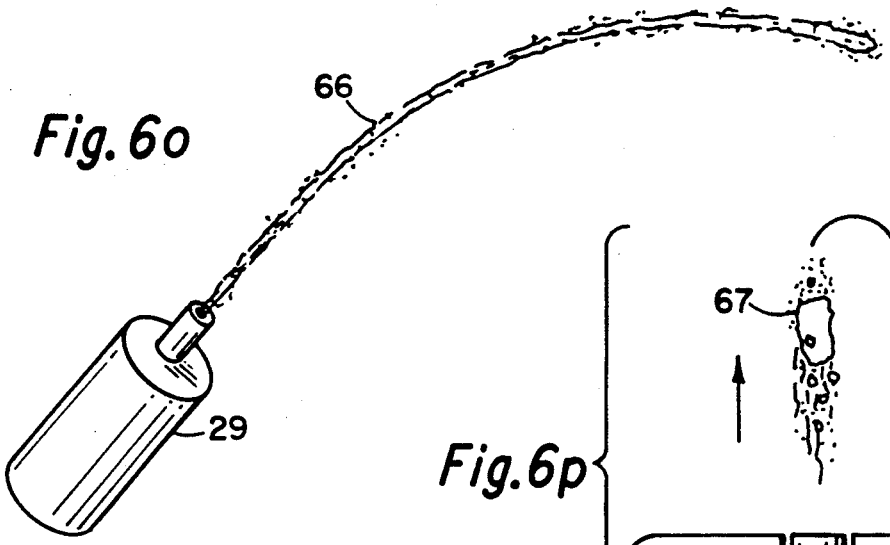
FIG. 6*o* indicates a laminar flow nozzle generating a laminer flow.

FIG. 6*o* depicts laminar flow nozzle 29 issuing a laminar flow 66 water effect. Laminar flow 66 differs from a normal jet in that the water is uni-directional and non-turbulent.

Figure 6P:
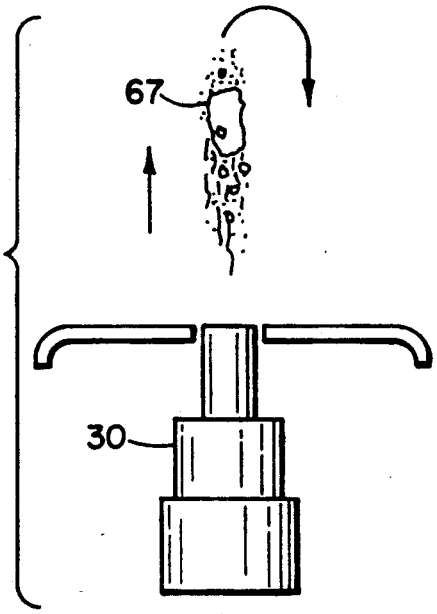
FIG. 6*p* Indicates a water ball nozzles shooting a water ball.

FIG. 6*p* depicts jumping water ball nozzle 30 issuing a jumping water ball 67 water effect.

Figure 6Q:
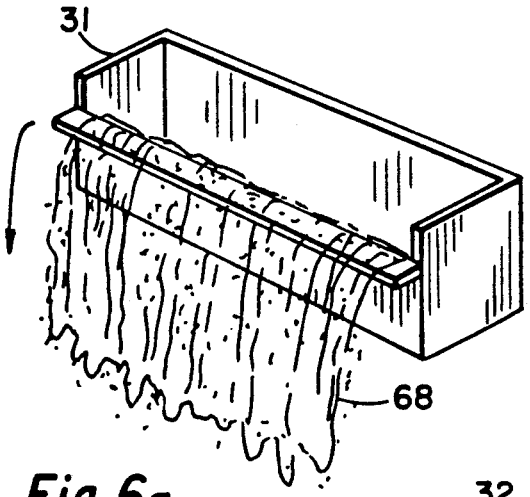
FIG. 6*q* details a curtain water fall weir creating a curtain water fall.

FIG. 6*q* details curtain water fall weir 31 creating a curtain water fall 68.

Figure 6R:
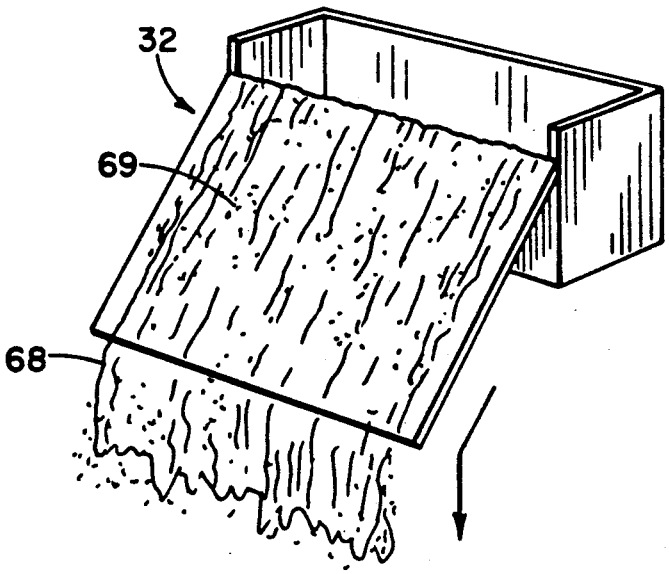
FIG. 6*r* details weir with inclined surface creating an inclined surface sheet with subsequent curtain water fall.

FIG. 6*r* details weir with inclined surface 32 creating an inclined surface sheet 69 with subsequent curtain water fall 68.

FIG. 6*s* pictures rake water fall weir 33 forming a rake water fall 70.

FIG. 6*t* pictures open pipe aperture 34 forming a non-pressurized gravity pour 71 water effect.

FIG. 6*u* illustrates a pool and runnel aperture 35 making a pond/stream/fall combo 72 water effect.

FIG. 6*v* illustrates connected bucket aperture 36 filling a bucket 37 and when tipped (as indicated by dotted lines) produces a bucket dump 73 water effect.

Figure 7A:
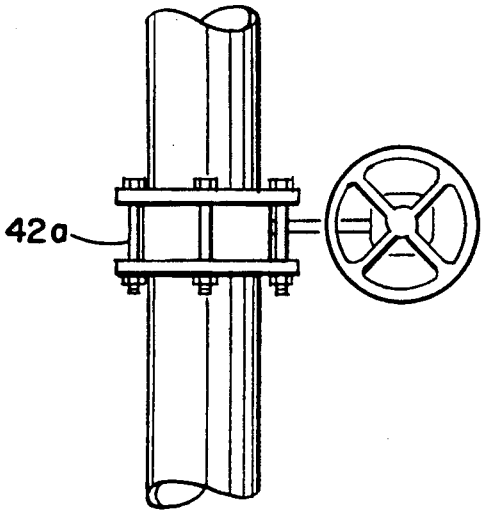
FIG. 7*a* details a wheel controlled butterfly valve.
Figure 7B:
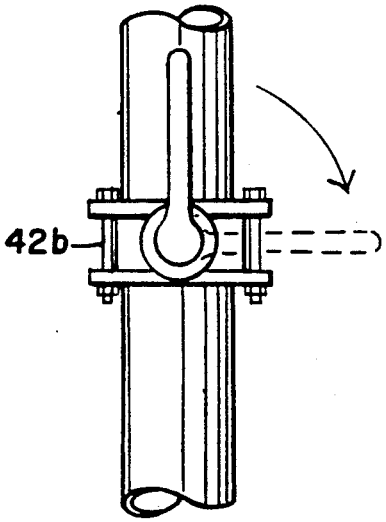
FIG. 7*b* details a lever controlled butterfly valve.
Figure 7C:
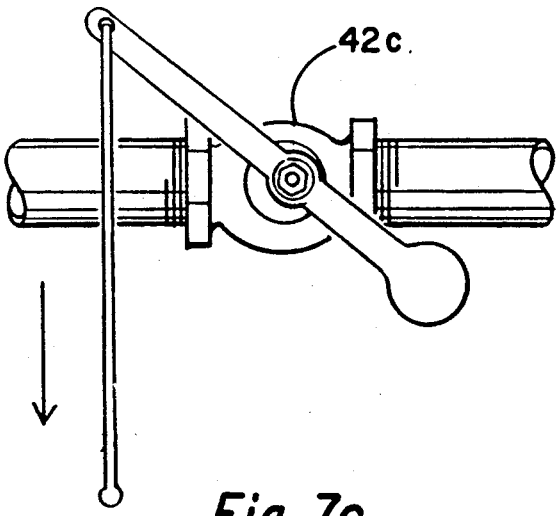
FIG. 7*c* shows a counter-weight valve.
Figure 7D:
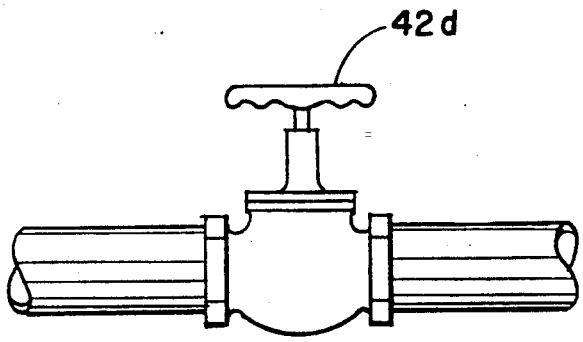
FIG. 7*d* shows a standard gate valve.
Figure 7E:
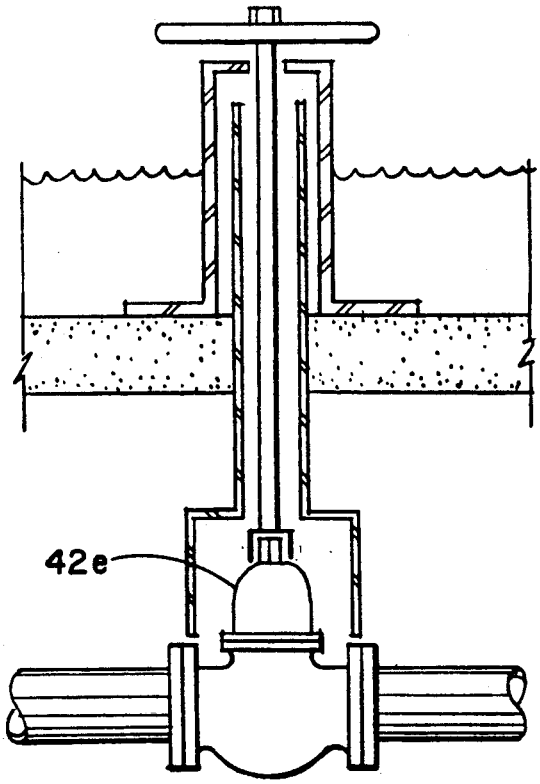
FIG. 7*e* shows a below water (or grade) gate valve.
Figure 7F:
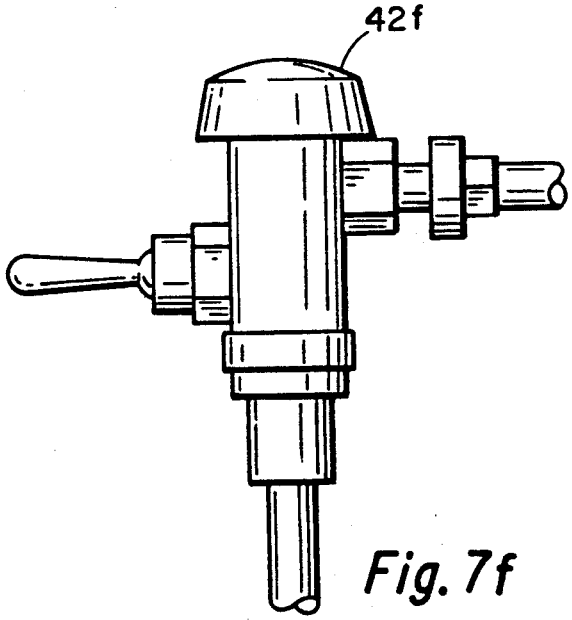
FIG. 7*f* shows a flush valve.
Figure 7G:
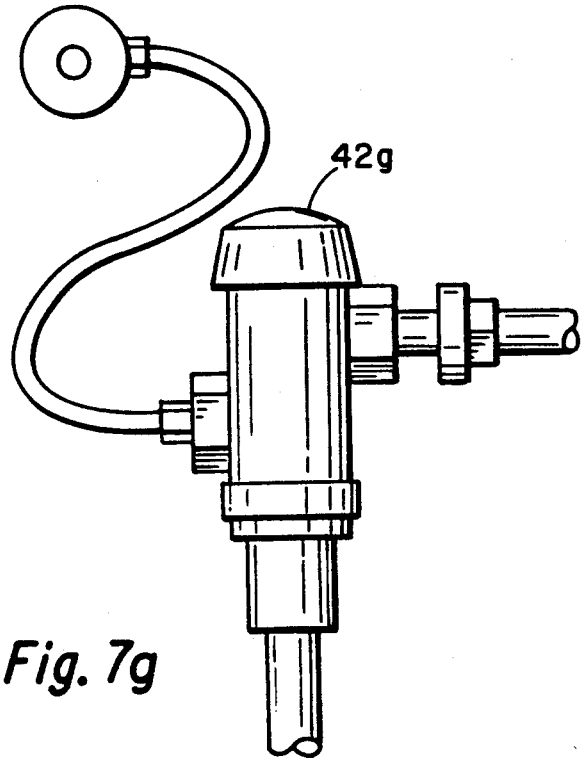
FIG. 7*g* shows a hydraulic flush valve.
Figure 7H:
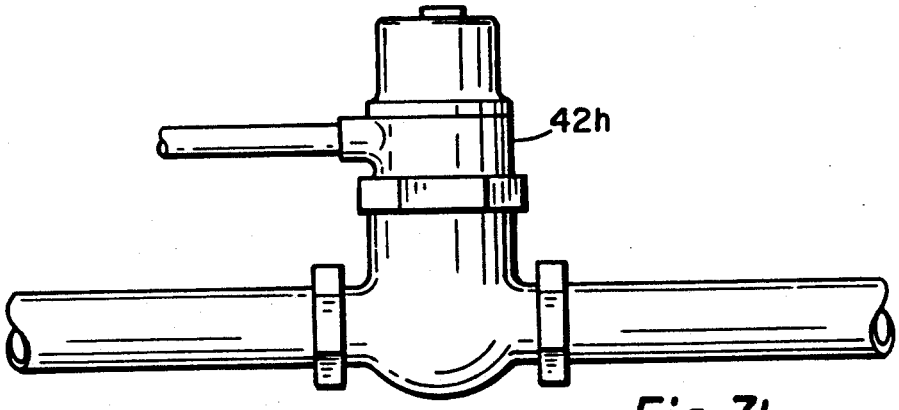
FIG. 7*h* illustrates a solenoid valve.
Figure 7I:
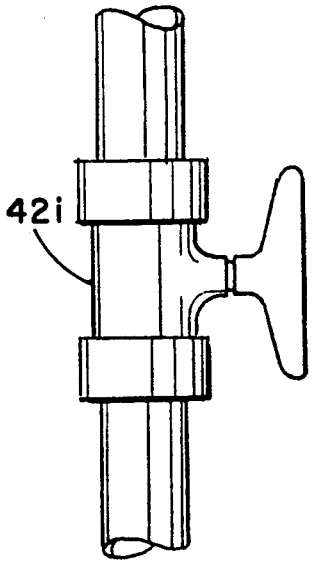
FIG. 7*i* details a lever controlled ball valve.
Figure 7J:
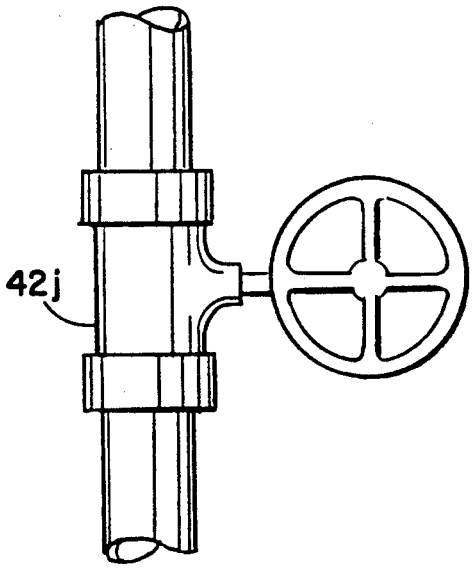
FIG. 7*j* details a wheel controlled ball valve.

FIG. 7*a* through FIG. 7*i* illustrate various control valves 42 utilized in the subject invention. FIG. 7*a* details a wheel controlled butterfly valve 42*a*. FIG. 7*b* details a lever controlled butterfly valve 42*b*. FIG. 7*c* shows a counter-weight valve 42*c*. FIG. 7*d* shows a standard gate valve 42*d*. FIG. 7*e* shows a below water (or grade) gate valve 42*e*. FIG. 7*f* shows a flush valve 42*f*. FIG. 7*g* shows a hydraulic flush valve 42*g*. FIG. 7*h* illustrates a solenoid valve 42*h*. FIG. 7*i* pictures lever controlled ball valve 42*i*. FIG. 7*j* pictures wheel controlled ball valve 42*j*. Control valves (42*a*, 42*b*, 42*c*, 42*d*, 42*e*, 42*f*, 42*g*, 42*h*, 42*i*, and 42*j*) are capable of association with any of the previously described water forming devices (22, 23, 24, 25, 26, 27, 28, 29, 30, 31, 32, 33, 34, 35, 36, and 37).

From the description above, a number of advantages of the endoskeletal participatory water play structure embodiment of this invention becomes evident:

(a) The sight, sound, and sensation of a multi-level superstructure filled with participant controlled valves that change water effects issuing form a multiplicity of water forming devices is a thrilling participant and observer experience. Participants (wet or dry) are invited to play and observes to visually enjoy hours of fun and fancy;

(b) A large scale high capacity participatory water play facility is now available for amusement and public parks;

(c) The integration of participatory water play components (e.g., play elements, valves, and water forming devices) into one synergistic unit results in a whole that is more exciting, creative and fun than the sum of its parts:

(d) Componentization of structural additions, water play elements and the water effects allows each component to be isolated by cost to provide for maximum purchaser budget flexibility and permit subsequent additions over a period of years.

(e) The use of a pool with water re-circulation system avoids damaging run-off and promotes water conservation.

OPERATION OF THE ENDOSKELETAL PARTICIPATORY WATER PLAY STRUCTURE

Turning to FIG. 5 circulating pump 45 is turned on to supply water through master control valve manifold 46 and onto endoskeleton 21. Master control valve manifold 46 allows the operator of an embodiment of the subject invention to regulate a safe, balanced and functional rate of flow to the various control valves and water forming means through endoskeleton 21. Furthermore, master control valve manifold 46 permits an operator to sequester specific regions of endoskeleton 21 to facilitate temporary shutdown of a defective water forming device, yet, still permit other functioning devices to operate for the enjoyment of participants 40.

Turning to FIG. 1, multiple participants 40 walk-/wade within pool 44 or climb and play upon stairs 54, floor platforms 57, ladders 55, and sets of bars 56 to reach and play upon either the non-water play elements (e.g., crow's nest 53, mirror 52, rotating/static tunnel 51, etc.), or to reach and play with the multiplicity of separate control valves 42 that operate the multiplicity of water flow devices with their corresponding water effect(s) (e.g., external nipples nozzle 22 with its various jet 60 (*a, b, c, d, e, f*) water effects; internal nipple nozzle 23 with its various jet 60(*a, b, c, d, e, f*) water effects; cone nozzle 24 with its umbrella spray 61*a* or cone spray 61*b;* water gun nozzle 25 with its water gun jet 62; geyser nozzle 26 with its geyser 63; platform nozzle 27 with its platform spout 64; fog nozzle 28 with its fog 65; laminar flow nozzle 29 with its laminar flow 66; jumping water ball nozzle 30 with its jumping water ball 67; curtain water fall weir 31 with its curtain water fall 68; weir with inclined surface 32 with its inclined surface sheet 69; rake water fall weir 33 with its rake water fall 70; open pipe aperture 34 with its non-pressurized gravity pour 71; pool and runnel aperture 35 with its pond/-stream/fall combo 72; and bucket aperture 36 with its bucket dump 73.

To operate and vary water effects (60, 61, 62, 63, 64, 65, 66, 67, 68, 69, 70, 71, 72, 73) that issue from associated water forming devices (22, 23, 24, 25, 26, 27, 28, 29, 30, 31, 32, 33, 34, 35, 36, 37) participant(s) 40 either turn, pull, push or hit control valve 42 dependent upon the type of control valve 42 that water forming devices (22, 23, 24, 25, 25, 26, 28, 29, 30, 31, 32, 33, 34, 35, 36, 37) are associated with. If control valve 42 is wheel controlled butterfly valve 42*a,* level controlled butterfly valve 42*i,* or gate valve 42*d* and 43*e,* then, participant 40 turns the wheel to restrict or open the flow of water 41 and thereby cause change in water effects to occur. If control valve 42 is lever controlled butterfly valve 42*b,* wheel controlled ball valve 42*j,* or flush valve 42*f* or 42*g,* then, participant 40 pushes or pulls the lever to restrict or open the flow of water 41 and cause change in water effects to occur. If control valve 42 is counter weight valve 42*c,* then, participant need only pull to open the flow of water 41 and the counter weight will automatically close the flow. If control valve 42 is a solenoid valve 42*h,* then, participant 40 need only hit an actuator button to cause a given water effect to change. The numerous combinations of forming device/control valve associations provide for abundant opportunities in creative participant water play.

Accordingly, it should now be apparent that the Endoskeletal participatory water play structure embodiment of this invention provides an exciting sensory participant and observer experience.

In addition, the Endoskeletal participatory water play structure has the following advantages:

The controllable valves utilized in the endoskeletal participatory water play structure allow changes to water effects by the simple physical act of a participant pushing a lever, pulling a rope, hitting a button or turning a valve. Such participant acts create a vast array of water effects resulting in a "live" hydrodynamically non-static structure that physically changes in appearance, sound, and texture each time it is used.

By operating the various valves and controlling the various water effects participants, especially young children, learn the cause and effect relationship between action (pulling a rope or turning a wheel) and reaction (getting doused with a gush of water or watching a geyser erupt). Interactive participation allows the participant to enhance their knowledge of water, its many shapes, forms, textures and consequences under various dynamic conditions.

DETAILED DESCRIPTION OF THE EXOSKELETAL PARTICIPATORY WATER PLAY STRUCTURE

Figure 8:
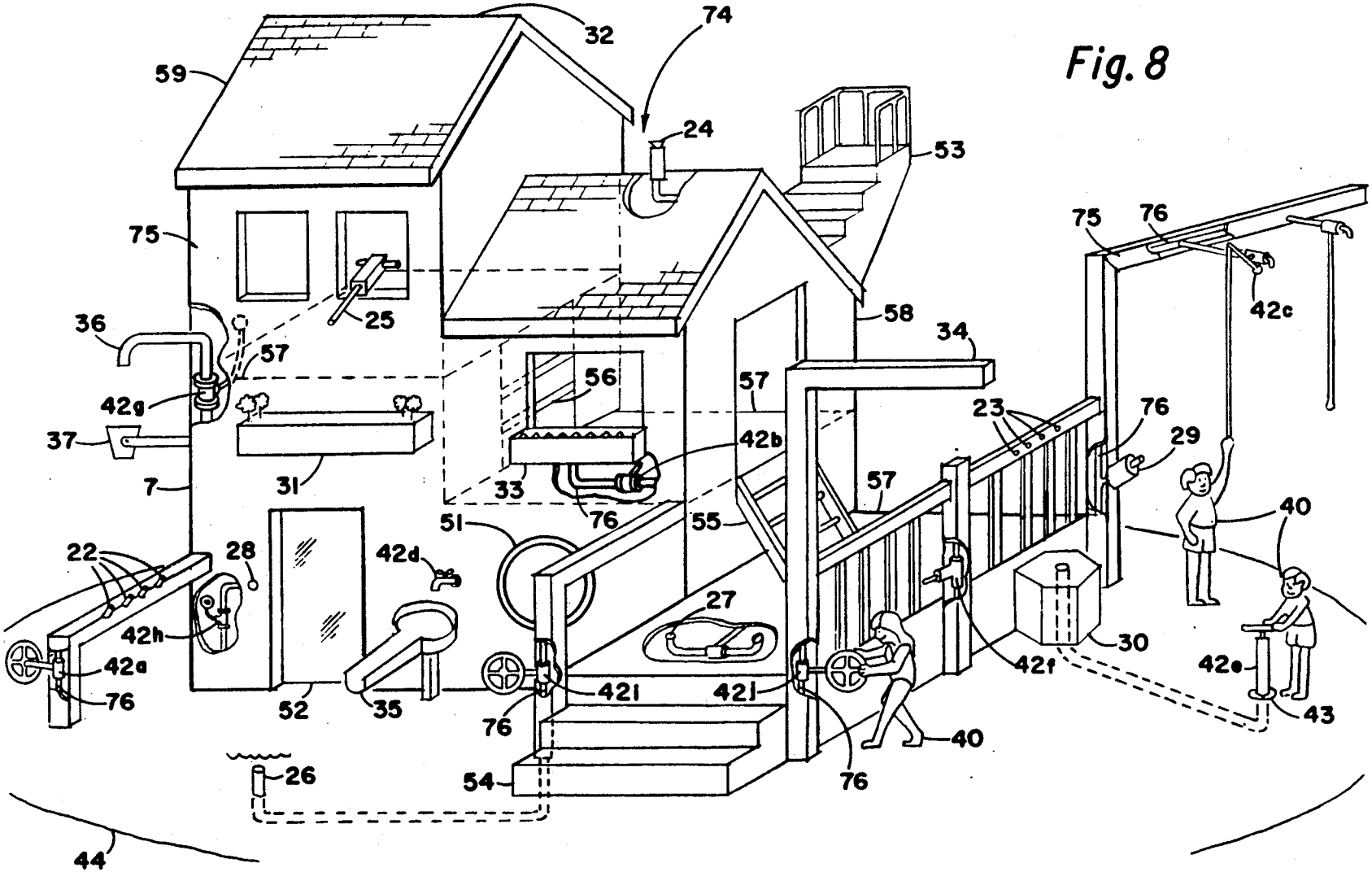
FIG. 8 depicts a generalized view of an exoskeletal "playhouse" participatory water play structure.

Turning now to FIG. 8 there is illustrated a perspective view of an embodiment of the subject invention known as an exoskeletal participatory water play structure 74. Exoskeletal participatory water play structure 74 is comprised of an external support system 75 and a non-load bearing circulatory conduit system 76 with connected water forming devices e.g., nozzles, weirs and apertures further described as follows: an external nipple nozzle(s) 22; an internal nipple nozzle(s) 23; a cone nozzle 24; a water gun nozzle 25; a geyser nozzle 26; a platform nozzle 27; a fog nozzle 28; a laminar flow nozzle 29; a jumping water ball nozzle 30; a curtain water fall weir 31; a weir with inclined surface 32; a rake water fall weir 33; an open pipe aperture 34; a pool and runnel aperture 35; a bucket aperture 36; and a hinged bucket 37. Water forming devices (22, 23, 24, 25, 26, 27, 28, 29, 30, 31, 32, 33, 34, 35, 36, 37) are secured to external support system 75 by appropriate means, e.g., glue, weld, nail, screw, threaded coupling or bolted flange (not shown). Circulatory conduit system 76 is connected to water forming devices (22, 23, 24, 25, 26, 27, 28, 29, 30, 31, 32, 33, 34, 35, 36, 37) by standard hose or pipe fittings (not shown).

To enable a participant(s) 40 to adjust the flow of water 41 to water forming devices (22, 23, 24, 25, 26, 27, 28, 29, 30, 31, 32, 33, 34, 35, 36, 37) a separate control valve 42 is connected to circulatory conduit system 76 at a point prior in the line of flow by way of standard hose or pipe fittings (not shown). Different types of control valves 42 are employed so as to require different types of participant 40 interaction. By way of example, control valves 42 include; wheel controlled butterfly valves 42*a;* lever controlled butterfly valves 42*b;* counter-weight valves 42*c;* standard gate valves 42*d;* below water (or grade) gate valves 42*e;* flush valves 42*f;* hydraulic flush valves 42*g;* solenoid valves 42*h;* lever control balled valves 42*i;* wheel controlled ball valves 42*j.*

The degree of valve control can range from between full water on to full water off and any desired intermediate position (akin to a rheostat), or limited to a simple water on/off (akin to a switch).

Non-water effect play elements can also be attached to external support system 75 to enhance participatory play. Examples of non-water effect play elements include a static/rotating tunnel 51; a mirror 52; and a crow's nest 53. Static/rotating tunnel 51 can also be utilized to connect to the varying elevations of external support system 75 and permit participant 40 to slide to different levels of exoskeletal participatory water play structure 74. Static/rotating tunnel 51, and crow's nest 53, can be fabricated from metal, PVC, fiberglass plastic, or other suitable material. Mirror 52 is fabricated of reflective metal or reflective plastic.

To facilitate participant 40 movement, a stair 54, a ladder 55, and a set of bars 56 connects different elevations of exoskeletal participatory water play structure 74. A floor platform 57 provides an elevated play area. Stair 54, ladder 55, bars 56 and floor platform 57 are attached to external support system 75 by eight welds or clamps (not shown). To assist in defining spatial boundaries throughout exoskeletal participatory water play structure 74, an enclosure panel 58 is attached by glue, welds or clamps (not shown). Enclosure panels 58 also serve to insure participant safety in the upper of exoskeletal participatory water play structure 74, as well as preventing unwanted participant entrapment. Roof panels 59 are positioned upon the uppermost levels of exoskeletal participatory water play structure 74 and can also serve as a shade device for participants 40. Stairs 54, ladders 55, bars 56, floor platforms 57, enclosure panels 58, and roof panels 59 are preferably made from metal, fiberglass, wood, PVC, reinforced fabric or other structurally suitable material.

A pool 44 within which exoskeletal participatory water play structure 74 is located can range in depth from a zero drainage basin to approximately 1 meter. At a minimum the width of pool 44 need extend an amount sufficient to collect the majority of wind-blown overspray. The maximum size of pool 44 is only limited by practicality and budget. Filtration and water heating systems are to be incorporated per local building code.

External support system 75 is made from any material suitable to sustain the requisite structural loads, e.g., metal; concrete; gunite; wood; fiberglass; or structural plastics/composites.

Non-load bearing circulatory conduit system 76 is made from hose, pipe, tubing, or other functionally shaped water carrying channel. All such conduit is hollow to allow passage of water 41. The size of conduit will range from a minimum of approximately 1 cm internal diameter to a maximum of approximately 40 cm internal diameter. Conduit can formed into diverse shapes by bending and piecing together different length sections with glue or joint welds or by pressure clamps, screws, threaded couplings or flanges (not shown).

At a minimum, exoskeletal participatory water play structure 74 defines a three dimensional external structural support system 75 with non-load bearing circuitory conduit system 76 of sufficient size to permit participants 40 to operate the connected water forming devices (22, 23, 24, 25, 26, 27, 28, 29, 30, 31, 32, 32, 33, 34, 35, 36, 37), associated values 42 (*a, b, c, d, e, f, g, h, i, j*) and incorporated play elements (50, 51, 52, 53). At a maximum the size of exoskeletal participatory water play structure 74 and the various valves, water forming devices and play elements are limited only by functionality, budget and site constraint.

Figure 10:
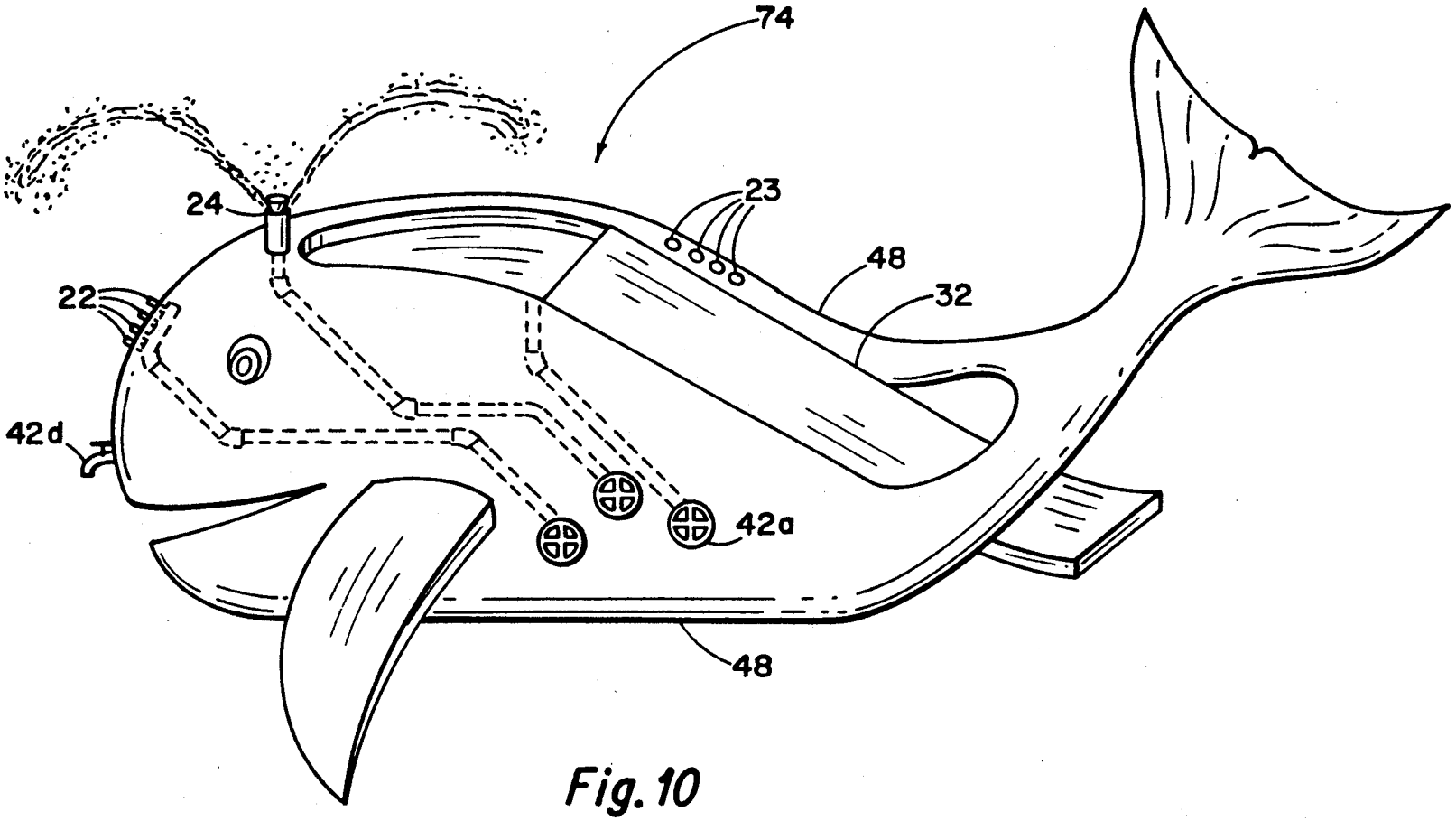
FIG. 10 depicts a further embodiment of an endoskeletal "whale" participatory water play structure with an exterior skin.

Similar to its endoskeletal counterpart, the shape of exoskeletal participatory water play structure 74 is easily conformed into recognizable vehicular or animal like structures. FIG. 10 depicts exoskeleton 21 in the shape of a participatory water play "whale", with water forming devices, e.g., external nipple nozzle(s) 22; internal nipple nozzle(s) 23; cone nozzle 24; weir with inclined surface 32; and with valves 42; e.g. wheel controlled butterfly valve 42*a* and gate valve 42*d*. Ladder 55 (not shown) assists participant 40 in movement onto the structure.

Flexibility in structural design and surfacing will facilitate a multiplicity of changeable exoskeletal embodiments, for example, different types of buildings (house, fort, teepee, firestation) or different types of vehicles (rocket ship, automobile, submarine, fireboat) or even different types of animals (whale, dinosaur, elephant). A user friendly surfacing material can be added as an exterior skin to exoskeletal participatory water play structure 74. Fiberglass or soft foam coatings are especially advantageous when the structural shell is made of a rough and unforgiving material such as concrete, gunite, or wood.

Figure 9:
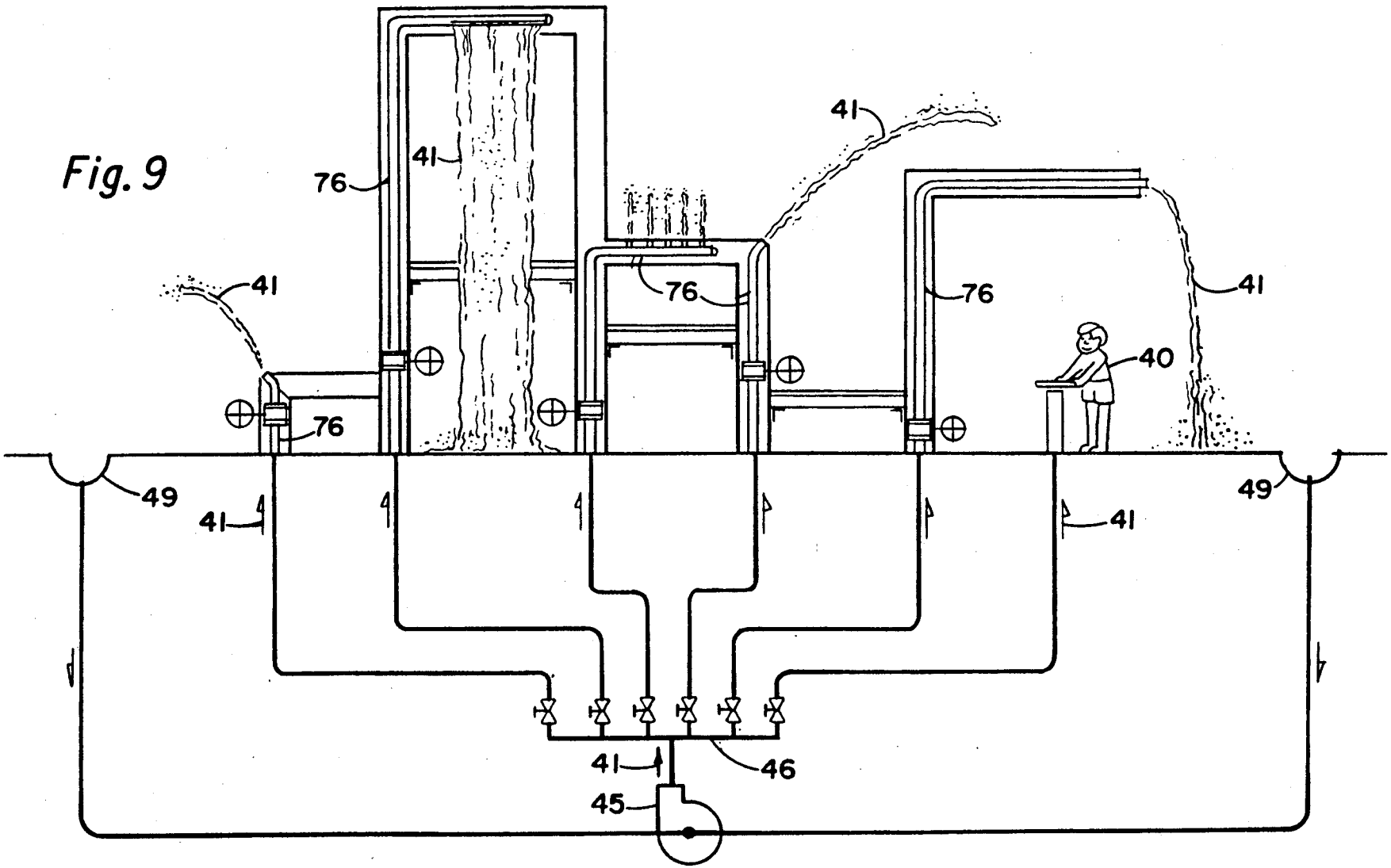
FIG. 9 is a schematic plumbing drawing for the exoskeletal play structure.

Turning to FIG. 9 there is illustrated a schematic plumbing diagram which illustrates the flow of water 41 throughout the subject invention. Circulation pump 45 supplies water 41 to master control valve manifold 46 which in turn provides for on/off and balanced water control to all regions of circulatory conduit system 76 as indicted. Master control valve manifold 46 is not intended for use by participants 40, rather, master control valve manifold 46 allows the operator of an embodiment of the subject invention to terminate service to all or specific regions of circulatory conduit system 76. A recirculating drain 49 enables water 41 to return to pump 45 for recirculation.

In exoskeletal participatory water play structure 74, water forming devices and associated water effects are substantially similar to those as illustrated in FIG. 6*a* through FIG. 6*v* of the previously described endoskeletal 21 embodiment. Consequently, for purposes of brevity, the following description will reference these drawings. However, it is to be understood that since circulatory conduit system 76 is non-structural, any water forming means connected therewith must be firmly secured and supported to external support system 75.

FIG. 6*a* through FIG. 6*v* illustrate representative water forming devices and their associated kinetic water effects. Starting with FIG. 6*a* (perspective view) and FIG. 6*b* (cross-section of 6*a*) there is detailed external nipple nozzle 22 comprised of an external nipple 47*a* which perforates the circulatory conduit system and is secured by glue, thread or weld. Jet 60 water effect issues form external nipple nozzle 22.

FIG. 6*c* (perspective view) and FIG. 6*d* (cross-section of 6*c*) details an internal nipple nozzle 23 which is similar to external nipple nozzle 22 except that internal nipple 47*b* is oriented inward, with the outside surface made smooth so that external appearance is simply of a hole. Internal nipple nozzle 23 are used for purposes of safety, especially in the lower regions of exoskeletal participatory water play structure 74 where participants 40 could make contact with any external nipples. External nipple nozzle 22 and internal nipple nozzle 23 produce similar jet 60 water effects, with external nipple nozzle 22 producing jet 60 with a slightly smoother rod like surface.

The orientation of nipple nozzles 22 and 23 relative to the force of gravity produces identifiably different jet water effects. FIG. 6*a* illustrates an arch jet 60*a* formed when nipple nozzle 22 is directed at a 45 degree angle from the vertical. FIG. 6*c* illustrates an angle jet 60*b* formed when nipple nozzle 23 is directed at a 90 degree angle from the vertical. FIG. 6*e* shows a series of vertical jets 60*c* produced when nipple nozzles 23 are directed vertically. FIG. 6*f* shows a series of bar jets 60*d* produced when nipple nozzles are directed downwardly. FIG. 6*g* depicts a series of horizontal jets 60*e* created when nipple nozzles 23 are oriented one-on-top-of-the-other along the vertical axis. FIG. 6*h* depicts a series of peacock jets 60*f* created when nipple nozzles 23 are linearly oriented around a curve.

FIG. 6*i* details cone nozzle 24. When oriented with cone nozzle 24 pointed predominantly vertically cone nozzle 24 produces an umbrella spray 61*a*. FIG. 6*j* shows cone nozzle 24 pointed in a predominantly downward direction and forming a cone spray 61*b*.

FIG. 6*k* illustrates water gun nozzle 25 forming a water gun jet 62.

FIG. 6*l* illustrates geyser nozzle 26 forming a geyser 63. In order for geyser 63 to properly form, geyser nozzle 26 must be positioned under a few inches of water and oriented towards the vertical.

FIG. 6*m* shows platform nozzle 27 comprised of external nipple nozzle 22 vertically positioned with nozzle opening flush with an opening through floor platform 57. Platform nozzle 27 forms a platform spout 64 water effect.

FIG. 6*n* shows fog nozzle 28 issuing a fog 65 water effect.

FIG. 6*o* depicts laminar flow nozzle 29 issuing a laminar flow 66 water effect. Laminar flow 66 differs from a normal jet in that the water is uni-directional and non-turbulent.

FIG. 6*p* depicts jumping water ball nozzle 30 issuing a jumping water ball 67 water effect.

FIG. 6*q* details curtain water fall weir 31 creating a curtain water fall 68.

FIG. 6*r* details weir with inclined surface 32 creating an inclined surface sheet 69 with subsequent curtain water fall 68.

FIG. 6*s* pictures rake water fall weir 33 forming a rake water fall 70.

FIG. 6*t* pictures open pipe aperture 34 forming a non-pressurized gravity pour 71 water effect.

FIG. 6*u* illustrates a pool and runnel aperture 35 making a pond/stream/fall combo 72 water effect.

FIG. 6*v* illustrates connected bucket aperture 36 filing a bucket 37 and when tipped (as indicated by dotted lines) produces a bucket dump 73 water effect.

FIG. 7*a* through FIG. 7*j* illustrates various control valves 42 utilized in the subject invention. FIG. 7*a* details a wheel controlled butterfly valve 42*a*. FIG. 7*b* details a lever controlled butterfly valve 42*a*. FIG. 7*c* shows a counter-weight valve 42*c*. FIG. 7*d* shows a standard gate valve 42*d*. FIG. 7*e* shows a below water (or grade) gate valve 42*e*. FIG. 7*f* shows a flush valve 42*f*. FIG. 7*g* shows a hydraulic flush valve 42*g*. FIG. 7*h* illustrates a solenoid valve 42*h*. FIG. 7*i* pictures lever controlled ball valve 42*i*. FIG. 7*j* pictures wheel controlled ball valve 42*j*. Control valves (42*a*, 42*b*, 42*c*, 42*d*, 42*e*, 42*f*, 42*g*, 42*h*, 42*i*, and 42*j*) re cable of association with any of the previously described water forming devices (22, 23, 24, 25, 26, 27, 28, 29, 30, 31, 32, 33, 34, 35, 36, and 37).

From the description above, a number of advantages of the exoskeletal participatory water play structure embodiment of this invention becomes evident:

(a) The exoskeletal orientation will permit different material choices and fabrication techniques for the subject inventions when compared to an endoskeletal orientation. This range of choices will enable the production of structures, e.g., vehicles, animals or buildings, that visually are more realistic in appearance. This flexibility will permit a broader product offering to satisfy the needs and desires of the marketplace.

(b) The sight, sound, and sensation of a multi-level superstructure filled with participant controlled valves that change water effects issuing from a multiplicity of water forming devices is a thrilling participant and observer experience. Participants (wet or dry) are invited to play and observers to enjoy hours of fun and fancy;

(c) A large scale high capacity participatory water play facility is now available for amusement and public parks;

(d) The integration of participatory water play components (e.g., play elements, valves, and water forming devices) into one synergistic unit results in a whole that is more exciting, creative and fun than the sum of its parts;

(e) Componentization of structural addition, water-play elements and the water effects allows each component to be isolated by cost to provide for maximum purchaser budget flexibility and permit subsequent additions over a period of years;

(f) The use of a pool with water re-circulation system avoids damaging run-off and promotes water conservation.

OPERATION OF THE EXOSKELETAL PARTICIPATORY WATER PLAY STRUCTURE

Turning to FIG. 9 circulation pump 45 is turned on to supply water through master control valve manifold 46 and into circulatory system 76. Master control valve manifold 46 allows the operator of an embodiment of the subject invention to regulate a safe, balanced and functional rate of flow to the various control valves and water forming means attached to circulatory system 76. Furthermore, master control valve manifold 46 permits an operator to sequester specific regions of circulatory system 76 to facilitate temporary shutdown of a defective water forming device, yet, still permit other functioning devices to operate for the enjoyment of participants 40.

Turning to FIG. 8, multiple participants 40 walk-/wade within pool 44 or climb and play upon stairs 54, floor platforms 57, ladders 55, and sets of bars 56 to reach and play upon either the non-water play elements (e.g., crow's nest 53, mirror 52, rotating/static tunnel 51, etc.), or to reach and play with the multiplicity of separate control valve 42 that operate the multiplicity of water flow devices with their corresponding water effect(s) (e.g., external nipple nozzle 22 with its various jet 60 (*a, b, c, d, e, f*) water effects; internal nipple nozzle 23 with its various jet 60 (*a, b, c, d, e, f*) water effects; cone nozzle 24 with its umbrella spray 61*a* or cone spray 61*b*; water gun nozzle 25 with its water gun jet 62; geyser nozzle 26 with its geyser 63; platform nozzle 27 with its platform spout 64; fog nozzle 28 with its fog 64; laminar flow nozzle 29 with its laminar flow 66; jumping water ball nozzle 30 with its jumping water ball 67; curtain water fall weir 31 with its curtain water fall 68; weir with inclined surface 32 with its inclined surface sheet 69; rake water fall weir 33 with its rake water fall 70; open pipe aperture 34 with its non-pressurized gravity pour 71; pool and runnel aperture 35 with its pond/-stream/fall combo 72; and bucket aperture 36 with its bucket dump 73).

To operate and vary water effects (60, 61, 62, 63, 64, 65, 66, 67, 68, 69, 70, 71, 72, 73) that issue from associated water forming devices (22, 23, 24, 25, 26, 27, 28, 29, 30, 31, 32, 33, 34, 35, 36, 37) participant(s) 40 either turn, pull, push or hit control valve 42 dependent upon the type of control valve 42 that water forming devices (22, 23, 24, 25, ,26, 27, 28, 29, 30, 31, 32, 33, 34, 35, 36, 37) are associated with. If control valve 42 is wheel controlled butterfly valve 42*a*, lever controlled ball valve 42*i* or a gate valve 42*c* and 42*d*, then, participant 40 turns the wheel to restrict or open the flow of water 41 and thereby cause change in water effects to occur. If control valve 42 is lever controlled butterfly valve 42*b*, wheel controlled ball valve 42*j*, or flush valve 42*f* or 42*g*, then, participant 40 pushes or pulls the lever to restrict or open the flow of water 41 and cause change in water effects to occur. If control valve 42 is counterweight valve 42*c*, then, participant need only pull to open the flow of water 41 and the counter weight will automatically close the flow. If control valve 42 is a solenoid valve 42*h*, then, participant 40 need only hit an actuator button to cause a given water effect to change. The numerous combinations of forming device/control valve associations provides for abundant opportunities in creative participant water play.

Accordingly, it should now be apparent that the exoskeletal participatory water play structure embodiment of this invention provides an exciting sensory participant and observer experience.

In addition, the exoskeletal participatory water play structure has the following advantages:

The differentiating structural characteristics of an exoskeletal system provides increased flexibility to meet prospective purchasers design and fiscal requirements.

The controllable valves utilized in the exoskeletal participatory water play structure allow changes to water effects by the simple physical act of a participant pushing a lever, pulling a rope, hitting a button or turning a valve. Such participant acts create an infinite array of water effects resulting in a "live" hydrodynamically non-static structure that physically changes in appearance, sound, and texture each time it is used.

By operating the various valves and controlling the various water effects participants, especially young children, learn the cause and effect relationship between action (pulling a rope or turning a wheel) and reaction (getting doused with a gush of water or watching a geyser erupt). Interactive participation allows the participant to enhance their knowledge of water, its many shapes, forms, textures and consequences under various dynamic conditions.

As will be recognized by those skilled in the art, certain modifications and changes can be made without departing from the spirit or intent of the present invention. For example, the dimensions given by way of scale or reference do not have to be geometrically precise, approximations are sufficient. The valves, water forming devices and associated water effects as specified in the embodiments described herein are deemed to be representative. Consequently, other valves, water forming devices and associated water effects currently known by those skilled in the art may be substituted to accomplish the intended objectives set forth above. Likewise, the structural shapes described herein (e.g., play house, fire truck and whale) are representative. Other structural shapes and characterization may be substituted to fit within the metes and bounds of the subject invention. Moreover, an alternate to the described circulation pump is an elevated reservoir. Finally, the terms and expressions which have been employed in the foregoing specifications are used therein as terms of description and not of limitation, and there is no intention, in the use of such terms and expressions, of excluding equivalents of the features shown and described, or portions thereof, it being recognized that the scope of the invention is defined and limited only by the claim which follow.

What I claim as my invention is:

1. A water play apparatus comprising:

a frame;

a first nozzle mounted on said frame at a first elevation for directing a spray of water into the air in a first direction, said nozzle forming said spray into a first spray pattern;

means for circulating water to said first nozzle;

a first valve mounted on said frame for controlling the flow of water circuitlated to said first nozzle;

a second nozzle mounted on said frame at a second elevation different from said first elevation for directing a spray of water into the air in a second direction different from said first direction, said nozzle forming said spray into a second spray pattern different from said first spray pattern;

means for circulating water to said second nozzle;

a second valve mounted on said frame for controlling the flow of water circulated to said second nozzle;

first means mounted on said frame for supporting a user of said apparatus at a third elevation, said first supporting means being positioned adjacent said first valve to permit a user of said apparatus on said supporting means to adjust said first valve;

second means mounted on said frame for supporting a user of said apparent at a fourth elevation, said second supporting means being positioned adjacent said second valve to permit a user of said apparatus on said second supporting means to adjust said second valve;

a basin for collecting water sprayed from said nozzles; and a pump for recirculating such collected water to said nozzles.

2. The apparatus of claim 1 wherein said frame is formed from interconnected pipe for circulating water to said nozzles and valves.

3. The apparatus of claim 1 wherein said frame is formed from substantially planar members and wherein said means for circulating water to said comprises conduits mounted on said planar members.

4. The apparatus of claim 1 wherein said frame forms a polyhedron.

5. The apparatus of claim 1 wherein said apparatus further includes a stair for providing access to one of said supporting means.

6. The apparatus of claim 1 wherein said apparatus further includes a ladder for providing access to one of said supporting means.

7. The apparatus of claim 1 wherein said apparatus further includes a structure having a roof and said walls mounted thereon.

8. The apparatus of claim 7 wherein said apparatus further includes a basin for collecting water sprayed from said nozzle.

9. The apparatus of claim 8 wherein said apparatus further includes a pump for recirculating such collected water in said pipe.

10. A water play apparatus comprising:

a frame;

first and second nozzles mounted on said frame at different locations, said nozzles being operable to spray water therefrom.

means for circulating water to said nozzles, and first and second valves mounted on said frame for independently controlling the flow of water to said first and second nozzles, respectively.

11. The apparatus of claim 10 wherein said apparatus further includes a first substantially planar platform mounted on said frame adjacent said first valve for permitting a user of said apparatus on said platform to control said first valve.

12. The apparatus of claim 1 wherein said apparatus further includes a second substantially planar platform mounted on said frame adjacent said second valve for permitting a user of said apparatus on said platform to control said second valve.

13. The apparatus of claim 12 wherein said apparatus further includes a basin for collecting water sprayed from said nozzles.

14. The apparatus of claim 13 wherein said apparatus further includes a pump for recirculating such collected water to said nozzles.

15. The apparatus of claim 12 wherein said frame is formed from substantially planar members and wherein said means for circulating water to said nozzles comprises conduits mounted on said planar members.

16. The apparatus of claim 12 wherein said frame comprises a plurality of pipes, some of said pipes being connected for communicating fluid to one another.

17. The apparatus of claim 12 wherein said first nozzles is constructed to spray in a first pattern and said second nozzle is constructed to spray in a second pattern.

18. The apparatus of claim 12 wherein said apparatus further includes a structure having a roof and said walls mounted thereon.

19. The apparatus of claim 12 wherein said apparatus further includes a stair for providing access to one of said platforms.

20. The apparatus of claim 12 wherein said apparatus further includes a ladder for providing access to one of said platforms.

21. A water play apparatus comprising:

a frame defining a three-dimensional object, said frame being formed from a plurality of pipes connected together for circulating water therethrough;

a plurality of substantially planar members mounted on said frame for further defining said three-dimensional object;

first and second nozzles mounted on said frame at different locations, said nozzles being operable to spray water therefrom; and first and second valves mounted on said frame for independently controlling the flow of water to said first and second nozzles, respectively.

* * * * *

UNITED STATES PATENT AND TRADEMARK OFFICE

CERTIFICATE OF CORRECTION

PATENT NO. : 5,194,048
DATED : March 16, 1993
INVENTOR(S) : Briggs

It is certified that error appears in the above-indentified patent and that said Letters Patent is hereby corrected as shown below:

| | |
|---|---|
| Column 1 | Line 7, change "Nov. 29, 1989" to --Nov. 20, 1989--; |
| Column 1 | Line 8, after "No." insert --Des.--; |
| Column 1 | Line 24, change "facilitates" to --facilities--; |
| Column 1 | Line 31, change "improvement" to --improvements--; |
| Column 1 | Line 61, change "3,539,181" to --4,057,244--; |
| Column 1 | Line 60, change "of" to --or--; |
| Column 3 | Line 14, change "later" to --latter--; |
| Column 4 | Line 20, change second "the" to --and--; |
| Column 4 | Line 45, change "an" to --a--; |
| Column 4 | Line 53, after "is" insert --a--; |
| Column 5 | Line 48, change "five" to --fire--; |
| Column 6 | Line 18, change "laminer" to --laminar--; |

UNITED STATES PATENT AND TRADEMARK OFFICE

CERTIFICATE OF CORRECTION

PATENT NO. : 5,194,048
DATED : March 16, 1993
INVENTOR(S) : Briggs

It is certified that error appears in the above-indentified patent and that said Letters Patent is hereby corrected as shown below:

| | |
|---|---|
| Column 6 | Line 19, change "nozzles" to --nozzle--; |
| Column 6 | Line 65, change "nozzles (s)" to --nozzle(s)--; |
| Column 7 | Line 1, change "wear" to --weir--; |
| Column 7 | Line 43, change "bar" to --bars--; |
| Column 8 | Line 11, change "joints" to --joint--; |
| Column 8 | Line 46, change "assists" to --assist--; |
| Column 8 | Line 55, change "surface" to --surfacing--; |
| Column 9 | Line 33, change "20" to --22--; |
| Column 9 | Line 50, change "nozzles" to --nozzle--; |
| Column 10 | Line 15, change "7i" to --7j--; |
| Column 10 | Line 38, change "observes" to --observers--; |
| Column 10 | Line 65, change "through" to --throughout--; |
| Column 11 | Line 35, change "level" to --lever--; |
| Column 11 | Line 36, change "43e" to --42e--; |

UNITED STATES PATENT AND TRADEMARK OFFICE

CERTIFICATE OF CORRECTION

PATENT NO. : 5,194,048
DATED : March 16, 1993
INVENTOR(S) : Briggs

It is certified that error appears in the above-indentified patent and that said Letters Patent is hereby corrected as shown below:

| | |
|---|---|
| Column 13 | Line 1, change "eight" to --either--; |
| Column 13 | Line 6, after "upper" insert --elevations--; |
| Column 13 | Line 18, after "zero" insert --depth--; |
| Column 13 | Line 34, after "can" insert --be--; |
| Column 13 | Lines 40-41, change "circuitory" to --circulatory--; |
| Column 13 | Line 44, change "values" to --valves--; |
| Column 14 | Line 11, change "indicted" to --indicated--; |
| Column 14 | Line 35, change "form" to --from--; |
| Column 14 | Line 40, change "that" to --the--; |
| Column 15 | Line 38, change "42a" to --42b--; |
| Column 15 | Line 46, change "re cable" to --are capable--; |
| Column 16 | Line 9, change "addition" to --additions--; |

UNITED STATES PATENT AND TRADEMARK OFFICE

CERTIFICATE OF CORRECTION

PATENT NO. : 5,194,048
DATED : March 16, 1993
INVENTOR(S) : Briggs

It is certified that error appears in the above-indentified patent and that said Letters Patent is hereby corrected as shown below:

| | |
|---|---|
| Column 16 | Line 39, change "valve" to --valves--; |
| Column 18 | Line 48, change "said" to --side--; |
| Column 19 | Line 3, change "1" to --11--; |
| Column 20 | Line 2, change "said" to --side--. |

Signed and Sealed this
Fifth Day of April, 1994

Bruce Lehman

*Attest:*

BRUCE LEHMAN

*Attesting Officer*

*Commissioner of Patents and Trademarks*